US011905684B2

(12) United States Patent
Inaoka et al.

(10) Patent No.: US 11,905,684 B2
(45) Date of Patent: Feb. 20, 2024

(54) HYDRAULIC SYSTEM FOR WORKING MACHINE, AND WORKING MACHINE

(71) Applicant: KUBOTA CORPORATION, Osaka (JP)

(72) Inventors: Masaki Inaoka, Osaka (JP); Daiki Abe, Osaka (JP); Takumi Usui, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 18/122,847

(22) Filed: Mar. 17, 2023

(65) Prior Publication Data

US 2023/0323636 A1 Oct. 12, 2023

(30) Foreign Application Priority Data

Mar. 23, 2022 (JP) ..... 2022-046982

(51) Int. Cl.
*E02F 9/22* (2006.01)
*E02F 3/34* (2006.01)

(52) U.S. Cl.
CPC ..... *E02F 9/2292* (2013.01); *E02F 9/2217* (2013.01); *E02F 9/2285* (2013.01); *E02F 3/3414* (2013.01); *E02F 9/2267* (2013.01); *E02F 9/2296* (2013.01)

(58) Field of Classification Search
CPC ..... E02F 9/2285; E02F 9/2217; E02F 9/128; E02F 9/2296
See application file for complete search history.

(56) References Cited

U.S. PATENT DOCUMENTS

2018/0163375 A1* 6/2018 Fukuda ..... E02F 9/2095

FOREIGN PATENT DOCUMENTS

JP 2018-096474 A 6/2018

* cited by examiner

*Primary Examiner* — Abiy Teka
(74) *Attorney, Agent, or Firm* — Greenblum & Bernstein, P.L.C.

(57) ABSTRACT

A hydraulic system for a working machine includes: a first hydraulic pump; a first hydraulic device; a hydraulic fluid tank; a first discharge fluid passage to allow hydraulic fluid discharged from the first hydraulic device to flow into the tank; a second hydraulic pump to suck fluid from the tank through a suction fluid passage; a second hydraulic device in which difference between flow rate of fluid from the second hydraulic pump device and that of discharged fluid changes according to actuation; a second discharge fluid passage connected to a suction port of the first hydraulic pump and allowing fluid discharged from the second hydraulic device to flow into the first hydraulic pump; a connecting fluid passage branching from the second discharge fluid passage and connected to the suction fluid passage between the tank and the second hydraulic pump; a supplier to supply fluid to the second discharge fluid passage.

22 Claims, 8 Drawing Sheets

HYDRAULIC SYSTEM FOR WORKING MACHINE, AND WORKING MACHINE

CROSS REFERENCE TO RELATED APPLICATIONS

This application claims the benefit of priority to Japanese Patent Application No. 2022-046982 filed on Mar. 23, 2022. The entire contents of this application are hereby incorporated herein by reference.

BACKGROUND OF THE INVENTION

1. Field of the Invention

The present invention relates to a hydraulic system for working machines such as skid-steer loaders and compact track loaders, and also relates to a working machine.

2. Description of the Related Art

A known hydraulic system for a working machine is disclosed by Japanese Unexamined Patent Application Publication No. 2018-96474.

The hydraulic system for a working machine that is disclosed by Japanese Unexamined Patent Application Publication No. 2018-96474 includes a first hydraulic pump, a first hydraulic device (working hydraulic device) which is to be actuated by hydraulic fluid delivered by the first hydraulic pump, a fluid passage (including a first discharge fluid passage, a third discharge fluid passage, and a sixth discharge fluid passage) which allows hydraulic fluid discharged from the first hydraulic device to flow into a drain receiver, a second hydraulic pump which is to deliver hydraulic fluid from the drain receiver and to which the second hydraulic pump is connected, a second hydraulic device (traveling hydraulic device) which is to be actuated by hydraulic fluid delivered by the second hydraulic pump and in which the difference between the flow rate of hydraulic fluid supplied from the second hydraulic pump to the second hydraulic device and the flow rate of hydraulic fluid discharged from the second hydraulic device changes according to the manner in which the second hydraulic device is actuated, and a fluid passage (including a seventh discharge fluid passage and an eighth discharge fluid passage) connected to the drain receiver and allowing hydraulic fluid discharged from the second hydraulic device to flow into the drain receiver.

SUMMARY OF THE INVENTION

In the hydraulic system for a working machine disclosed by Japanese Unexamined Patent Application Publication No. 2018-96474, the hydraulic fluid discharged from the traveling hydraulic device flows through the seventh discharge fluid passage and the eighth discharge fluid passage into the drain receiver, whereas hydraulic fluid discharged from the working hydraulic device flows through the first discharge fluid passage, the third discharge fluid passage, and the sixth discharge fluid passage into the drain receiver.

However, in the case where the drain receiver that receives the hydraulic fluid discharged from the traveling hydraulic device is a hydraulic fluid tank and the drain receiver that receives the hydraulic fluid discharged from the working hydraulic device is a suction port of the first hydraulic pump, if the second hydraulic device is a hydraulic cylinder or the like in which the flow rate of hydraulic fluid discharged therefrom changes according to the manner in which it is actuated and if the flow rate of hydraulic fluid discharged therefrom becomes smaller than the flow rate of the hydraulic fluid supplied thereto, a negative pressure may be generated in the fluid passage that is connected to the suction port of the first hydraulic pump.

The present invention is to solve the above problem in the known art and to provide a hydraulic system for a working machine and a working machine in each of which stable supply of hydraulic fluid to the first hydraulic device is achieved regardless of the manner in which the second hydraulic device is actuated.

A hydraulic system for a working machine according to an aspect of the present invention includes: a first hydraulic pump; a first hydraulic device to be actuated by hydraulic fluid delivered by the first hydraulic pump; a hydraulic fluid tank to store hydraulic fluid; a first discharge fluid passage to allow hydraulic fluid discharged from the first hydraulic device to flow into the hydraulic fluid tank; a second hydraulic pump to suck hydraulic fluid from the hydraulic fluid tank through a suction fluid passage, the second hydraulic pump being connected to the hydraulic fluid tank via the suction fluid passage; a second hydraulic device to be actuated by hydraulic fluid delivered by the second hydraulic pump, the second hydraulic device being configured such that a difference between a flow rate of hydraulic fluid supplied from the second hydraulic pump to the second hydraulic device and a flow rate of hydraulic fluid discharged from the second hydraulic device changes according to a manner in which the second hydraulic device is actuated; a second discharge fluid passage to allow hydraulic fluid discharged from the second hydraulic device to flow into the first hydraulic pump, the second discharge fluid passage being connected to a suction port of the first hydraulic pump; a connecting fluid passage branching off from the second discharge fluid passage and connected to the suction fluid passage; and a supplier to additionally supply hydraulic fluid to the second discharge fluid passage, the supplier being connected to the second discharge fluid passage.

The second hydraulic device may be a hydraulic cylinder and include a cylinder tube, a piston provided inside the cylinder tube, and a rod attached to the piston.

The supplier may be a bypass fluid passage connecting the second discharge fluid passage and the hydraulic fluid tank.

An inside diameter of the bypass fluid passage may be greater than an inside diameter of the connecting fluid passage and an inside diameter of the second discharge fluid passage.

The supplier may be an accumulator to accumulate hydraulic fluid and to supply the accumulated hydraulic fluid to the second discharge fluid passage.

The supplier may be an auxiliary tank to store hydraulic fluid independently of the hydraulic fluid tank and to supply the stored hydraulic fluid to the second discharge fluid passage.

The auxiliary tank may be provided with a breather to allow an inside and an outside of the auxiliary tank to communicate with each other.

The second discharge fluid passage may be provided with an oil cooler to cool hydraulic fluid.

The hydraulic system for a working machine may further include a prime mover. The first hydraulic device may include: a traveling pump to be actuated by power from the prime mover; a traveling motor to be rotated by hydraulic fluid delivered by the traveling pump; a circulatory fluid passage connecting the traveling pump and the traveling motor; and a charging fluid passage to allow hydraulic fluid delivered by the first hydraulic pump to be supplied to the circulatory fluid passage.

A working machine includes a hydraulic system for a working machine, a machine body, a traveling device to be driven by the first hydraulic device and to provide a propelling force to the machine body, the machine body being provided with the traveling device; and a working device to be driven by the second hydraulic device, the machine body being provided with the working device.

The above and other elements, features, steps, characteristics and advantages of the present invention will become more apparent from the following detailed description of the preferred embodiments with reference to the attached drawings.

BRIEF DESCRIPTION OF THE DRAWINGS

A more complete appreciation of preferred embodiments of the present invention and many of the attendant advantages thereof will be readily obtained as the same becomes better understood by reference to the following detailed description when considered in connection with the accompanying drawings described below.

DETAILED DESCRIPTION OF THE PREFERRED EMBODIMENTS

Figure 1:
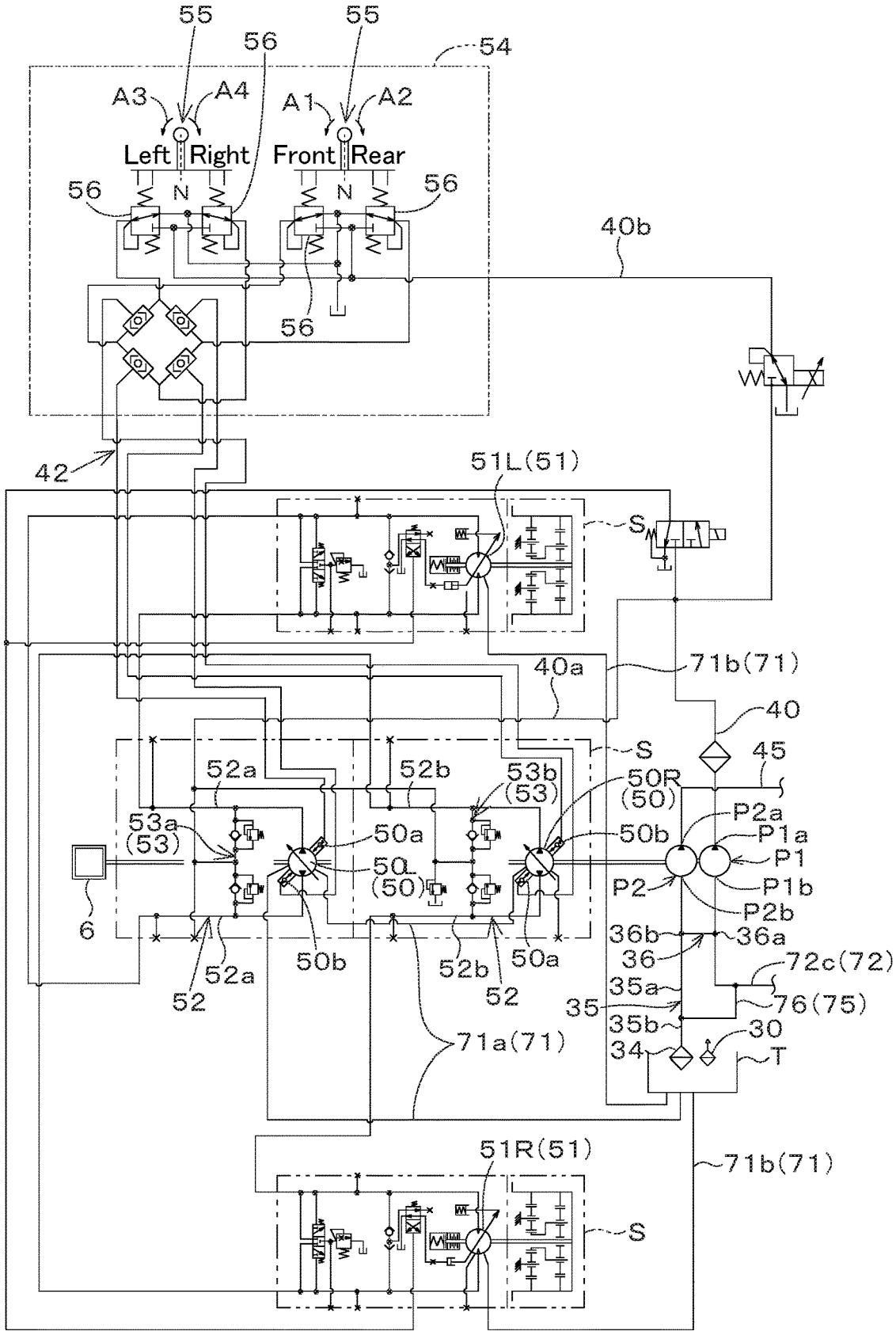
FIG. 1 illustrates a hydraulic circuit of a travel system portion of a hydraulic system for a working machine according to a first embodiment.

The preferred embodiments will now be described with reference to the accompanying drawings, wherein like reference numerals designate corresponding or identical elements throughout the various drawings. The drawings are to be viewed in an orientation in which the reference numerals are viewed correctly.

Embodiments of the present invention will now be described with reference to the drawings.

First Embodiment

Figure 8:
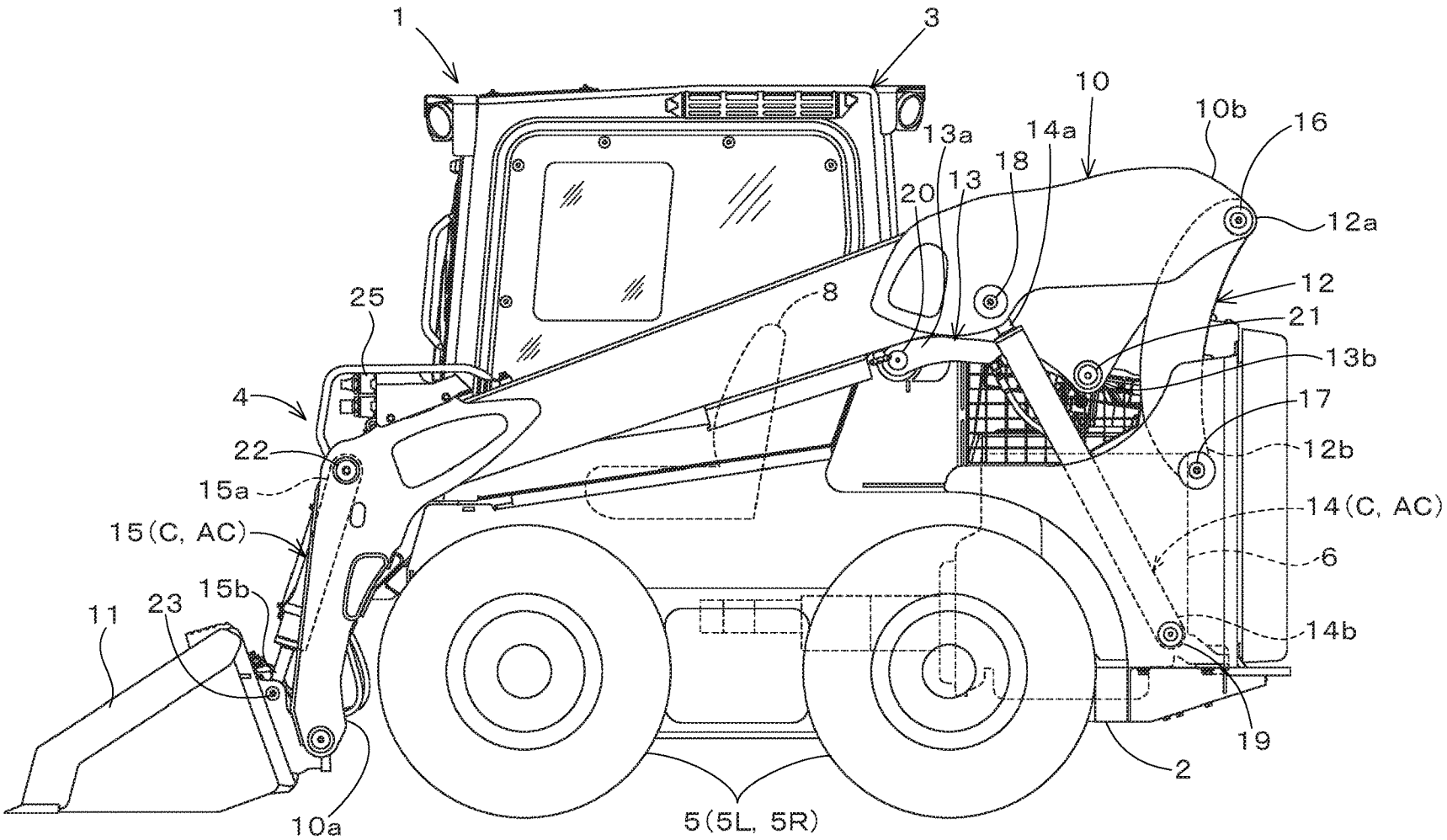
FIG. 8 is a side view of a skid-steer loader as an example of a working machine.

FIG. 8 is a side view of a working machine 1 according to the present invention. The working machine 1 illustrated as an example in FIG. 8 is a skid-steer loader. Note that the working machine 1 according to the present invention is not limited to a skid-steer loader and may be any other loader such as a compact track loader. The working machine 1 may be any other working machine instead of a loader.

As illustrated in FIG. 8, the working machine 1 includes a machine body 2, a cabin 3, a working device 4, and at least one traveling device 5. In the embodiment of the present invention, the side (the left side in FIG. 8) toward which the operator sitting on an operator's seat 8 of the working machine 1 faces is defined as the front side, and the opposite side (the right side in FIG. 8) is defined as the rear side. Furthermore, the left-hand side of the operator (the near side in FIG. 8) is defined as the left side, and the right-hand side of the operator (the far side in FIG. 8) is defined as the right side. Furthermore, a horizontal direction that is orthogonal to the front-rear direction is defined as the machine-body width direction.

The cabin 3 is mounted on the machine body 2. The cabin 3 is provided with the operator's seat 8. The working device 4 is attached to the machine body 2. The machine body 2 includes in a rear portion thereof a prime mover 6. The at least one traveling device 5 is provided outside the machine body 2. The at least one traveling device 5 includes a first traveling device 5L, which is provided on the left side of the machine body 2; and a second traveling device 5R, which is provided on the right side of the machine body 2.

Referring to FIG. 8, the working device 4 will now be described in detail. The working device 4 includes booms 10, a working tool 11, lift links 12, control links 13, boom cylinders 14, and bucket cylinders 15.

The booms 10 are provided on the left and right sides of the cabin 3 in such a manner as to be swingable up and down. The working tool 11 is, for example, a bucket and is attached to first ends (front ends) 10*a* of the booms 10 in such a manner as to be swingable up and down. Each boom 10 is supported at a second end (rear end) 10*b*, opposite the first end 10*a*, thereof by a corresponding lift link 12 and a corresponding control link 13 in such a manner as to be swingable up and down. The boom cylinders 14 are extendable and retractable to raise and lower the booms 10. The bucket cylinders 15 are extendable and retractable to swing the working tool 11.

The boom 10 on the left side and the boom 10 on the right side are coupled to each other at the first ends (front ends) 10*a* thereof with an irregular-shaped coupling pipe (not illustrated). The boom 10 on the left side and the boom 10 on the right side are also coupled to each other at the second ends (rear ends) 10*b* thereof with a circular coupling pipe.

The lift links 12, the control links 13, the boom cylinders 14, and the bucket cylinders 15 are provided for the respective left and right booms 10, that is, on the left and right sides of the machine body 2, respectively.

Each lift link 12 is attached to a rear portion of the second end 10*b* of a corresponding boom 10 and is oriented upright. A first end (upper end) 12*a* of the lift link 12 is pivoted via a pivot 16 on the rear portion of the second end 10*b* of the boom 10 such that the lift link 12 is rotatable about a horizontal axis. A second end (lower end) 12*b*, opposite the first end 12*a*, of the lift link 12 is pivoted via a pivot 17 on a rear portion of the machine body 2 such that the lift link 12 is rotatable about a horizontal axis.

Each boom cylinder 14 is pivoted at a first end (upper end) 14*a* thereof by a pivot 18 in such a manner as to be rotatable about a horizontal axis. The pivot 18 is provided at a front portion of the second end 10*b* of a corresponding boom 10. The boom cylinder 14 is pivoted at a second end (lower end)

14*b*, opposite the first end 14*a*, thereof by a pivot 19 in such a manner as to be rotatable about a horizontal axis. The pivot 19 is provided at a lower rear portion of the machine body 2.

Each control link 13 is located forward of a corresponding lift link 12. The control link 13 is pivoted at a first end (front end) 13*a* thereof by a pivot 20 in such a manner as to be rotatable about a horizontal axis. The pivot 20 is provided on the machine body 2 and is located forward of the lift link 12. The control link 13 is pivoted at a second end (rear end) 13*b*, opposite the first end 13*a*, thereof by a pivot 21 in such a manner as to be rotatable about a horizontal axis. The pivot 21 is provided on a corresponding boom 10 and is located higher than and forward of the pivot 17.

Therefore, the boom 10 supported at the second end 10*b* thereof by the lift link 12 and the control link 13 is swingable up and down about the pivot 16 with the extension and retraction of the boom cylinder 14. Thus, the first end 10*a* of the boom 10 is raised and lowered. Furthermore, with the up-and-down swinging of the boom 10, the control link 13 swings up and down about the pivot 20. With the up-and-down swinging of the control link 13, the lift link 12 swings back and forth about the pivot 17.

Note that, although the working tool 11 illustrated in FIG. 8 is a bucket attached to the first ends 10*a* of the booms 10, another working tool 11 instead of a bucket may be attached to the first ends 10*a* of the booms 10. Examples of another working tool 11 attachable to the first ends 10*a* of the booms 10 include attachments (auxiliary attachments) such as a hydraulic crusher, a hydraulic breaker, an angle broom, an earth auger, a pallet fork, a sweeper, a mower, and a snow blower. Such an auxiliary attachment includes hydraulic component(s) such as a hydraulic motor and/or hydraulic cylinder(s) C and is actuated by hydraulic fluid supplied thereto.

The left boom 10 is provided at the first end 10*a* thereof with at least one connector 25. Each connector 25 is to connect a first tube (not illustrated) which is connected to an auxiliary attachment and a second tube (not illustrated) which is a pipe or the like attached to the boom 10 to each other.

The bucket cylinders 15 are provided at the first ends 10*a* of the respective booms 10. Each bucket cylinder 15 is pivoted at a first end (upper end) 15*a* thereof by a pivot 22 in such a manner as to be rotatable about a horizontal axis. The pivot 22 is provided at a rear portion of the first end 10*a* of a corresponding boom 10. The bucket cylinder 15 is pivoted at a second end (lower end) 15*b*, opposite the first end 15*a*, thereof by a pivot 23 in such a manner as to be rotatable about a horizontal axis. The pivot 23 is provided at an upper rear portion of the working tool 11. The bucket cylinder 15 is extendable and retractable to swing the working tool 11.

Hereinafter, the bucket cylinders 15, the boom cylinders 14, and the hydraulic component(s) included in the auxiliary attachment may each be also referred to as a hydraulic actuator AC.

The left traveling device 5 (first traveling device 5L) and the right traveling device 5 (second traveling device 5R) in the present embodiment are wheeled traveling devices 5 each including a front wheel and a rear wheel. Each traveling device 5 is not limited to a wheeled device illustrated in FIG. 8 and may be a crawler traveling device or a semi-crawler traveling device.

The prime mover 6 is an internal combustion engine such as a diesel engine or a gasoline engine, an electric motor, and/or the like. The prime mover 6 according to the present embodiment is, but is not limited to, a diesel engine.

Figure 2:
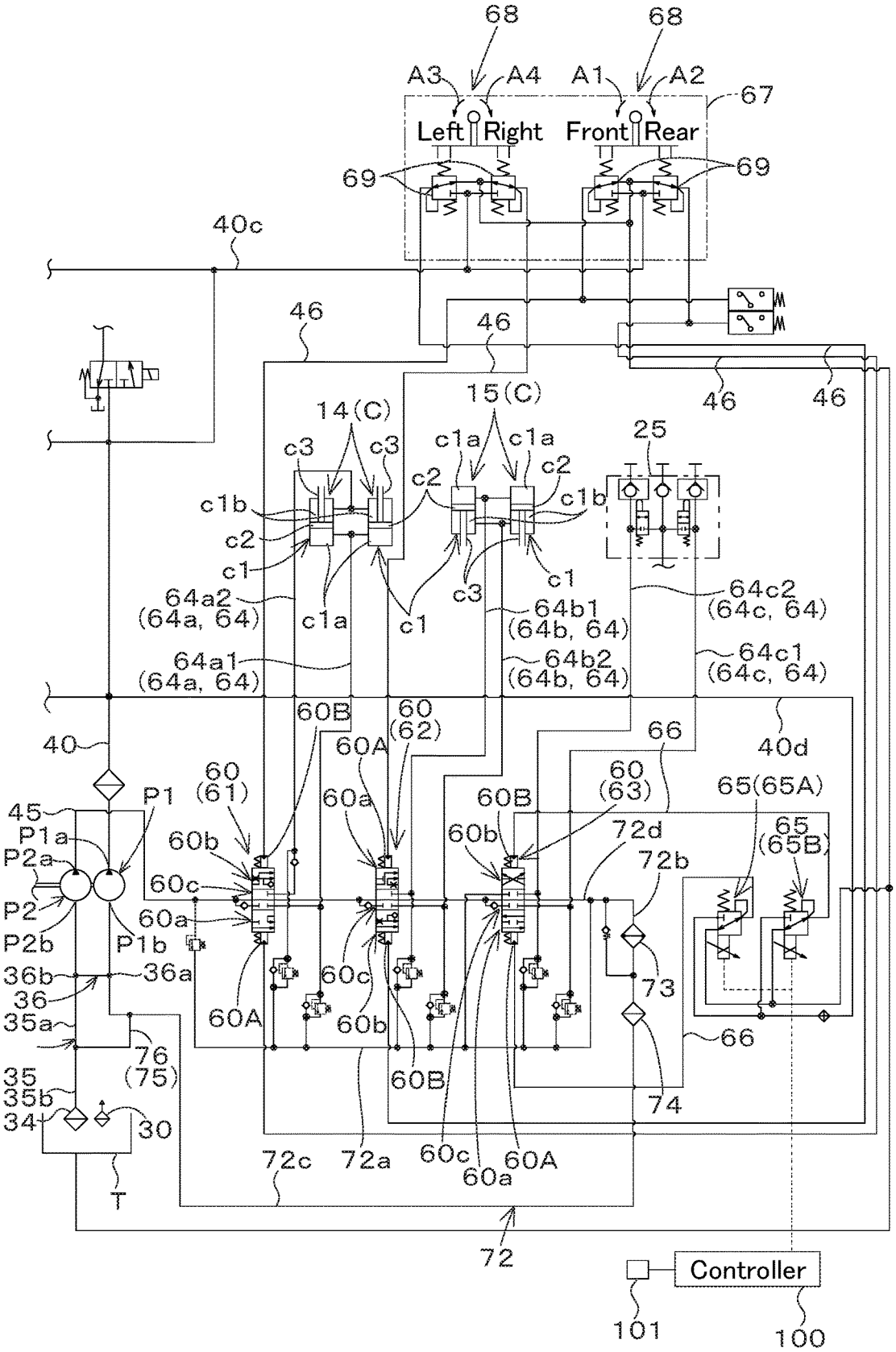
FIG. 2 illustrates a hydraulic circuit of a work system portion of the hydraulic system for a working machine according to the first embodiment.

The following discusses a hydraulic system for the working machine 1. FIG. 1 illustrates a hydraulic circuit of a travel system portion of the hydraulic system for the working machine 1 according to the first embodiment. FIG. 2 illustrates a hydraulic circuit of a work system portion of the hydraulic system for the working machine 1 according to the first embodiment.

As illustrated in FIGS. 1 and 2, the working machine 1 includes a first hydraulic pump P1, a second hydraulic pump P2, and a hydraulic fluid tank T. The first hydraulic pump P1 is actuated by power from the prime mover 6 and delivers hydraulic fluid. The first hydraulic pump P1 is a fixed-displacement gear pump. In particular, the first hydraulic pump P1 supplies hydraulic fluid for use in controlling the travel system and the work system of the working machine 1. Note that the portion of the hydraulic fluid delivered by the first hydraulic pump P1 that is for use in controlling may be hereinafter referred to as pilot fluid, and the pressure of the pilot fluid may be hereinafter referred to as pilot pressure. Specifically, the first hydraulic pump P1 has a delivery port (first port) Pla to which a first delivery fluid passage 40 is connected. The first delivery fluid passage 40 allows hydraulic fluid delivered by the first hydraulic pump P1 to flow therethrough. The first hydraulic pump P1 has a suction port (second port) Plb to which a second discharge fluid passage 72 (described later) is connected.

The second hydraulic pump P2 is actuated by power from the prime mover 6 and delivers hydraulic fluid. The second hydraulic pump P2 is a fixed-displacement gear pump. In particular, the second hydraulic pump P2 supplies hydraulic fluid to the work system portion of the hydraulic system (described later). Specifically, the second hydraulic pump P2 has a delivery port (third port) P2*a* to which a second delivery fluid passage 45 is connected. The second delivery fluid passage 45 allows hydraulic fluid delivered by the second hydraulic pump P2 to flow therethrough. The second hydraulic pump P2 has a suction port (fourth port) P2*b* having connected thereto a suction fluid passage 35 through which hydraulic fluid is supplied to the second hydraulic pump P2. The suction fluid passage 35 connects the fourth port P2*b* of the second hydraulic pump P2 and the hydraulic fluid tank T to each other. That is, the second hydraulic pump P2 sucks hydraulic fluid from the hydraulic fluid tank T through the suction fluid passage 35. Specifically, the hydraulic fluid tank T is provided with an oil filter (suction filter) 34 therein to which the suction fluid passage 35 is connected.

An arrangement in which the second port Plb of the first hydraulic pump P1 is not connected to the hydraulic fluid tank T but is connected to the second discharge fluid passage 72 whereas the fourth port P2*b* of the second hydraulic pump P2 is connected to the hydraulic fluid tank T through the suction fluid passage 35, as in the present embodiment, makes it possible to reduce the total amount of hydraulic fluid that flows through the hydraulic system for the working machine 1. This makes it possible to reduce the size of the hydraulic fluid tank T.

The flow rate of hydraulic fluid delivered by the second hydraulic pump P2 per predetermined period of time is greater than or equal to the flow rate of hydraulic fluid delivered by the first hydraulic pump P1 per predetermined period of time. In the present embodiment, the flow rate of hydraulic fluid delivered by the second hydraulic pump P2 per predetermined period of time is greater than the flow rate of hydraulic fluid delivered by the first hydraulic pump P1 per predetermined period of time.

The hydraulic fluid tank T stores hydraulic fluid. Specifically, the suction fluid passage 35 connected to the hydraulic fluid tank T allows hydraulic fluid sucked from the hydraulic fluid tank T by the second hydraulic pump P2 to flow therethrough. The hydraulic fluid tank T is provided with a breather (air breather) 30 to allow the inside and the outside of the hydraulic fluid tank T to communicate with each other.

The following description discusses the travel system portion of the hydraulic system with reference to FIG. 1. The travel system portion of the hydraulic system for the working machine 1 actuates the traveling devices 5. The hydraulic system for the working machine 1 includes first hydraulic device(s) S. The first hydraulic device(s) S is actuated by hydraulic fluid delivered by the first hydraulic pump P1. The first hydraulic device(s) S drives the traveling devices 5 and includes at least one traveling pump 50, at least one traveling motor 51, at least one circulatory fluid passage 52, and at least one charging fluid passage 53.

The at least one traveling pump 50 is actuated by power from the prime mover 6. The at least one traveling pump 50 according to the present embodiment includes a first traveling pump SOL and a second traveling pump 50R. Specifically, each traveling pump 50 is a swash-plate variable displacement axial pump to be actuated by power from the prime mover 6. The traveling pump 50 includes a forward-traveling pressure receiver 50*a* and a backward-traveling pressure receiver 50*b* to each of which pilot pressure is applied. The angle of the swash plate of the traveling pump 50 is changed according to the pilot pressures applied to the forward-traveling pressure receiver 50*a* and the backward-traveling pressure receiver 50*b*. As the angle of the swash plate of the traveling pump 50 is changed, the traveling pump 50 changes the amount (output) and the direction in which the traveling pump delivers hydraulic fluid supplied from the first delivery fluid passage 40 through the charging fluid passage 53.

The least one traveling motor 51 includes traveling motors 51 to be actuated by hydraulic fluid delivered by the traveling pumps 50 and to transmit power to the driving shafts of the traveling devices 5. Therefore, the traveling devices 5 can be driven by first hydraulic devices S (the traveling motors 51) to impart a propelling force to the machine body 2. The traveling motors 51 according to the present embodiment include a first traveling motor 51L and a second traveling motor 51R. The first traveling motor 51L transmits power to the driving shaft of the traveling device 5 (the first traveling device 5L) provided on the left side of the machine body 2. The second traveling motor 51R transmits power to the driving shaft of the traveling device 5 (the second traveling device 5R) provided on the right side of the machine body 2.

The at least one circulatory fluid passage 52 connects the traveling pumps 50 and the traveling motors 51 to each other. The at least one circulatory fluid passage 52 according to the present embodiment includes a first circulatory fluid passage 52*a* and a second circulatory fluid passage 52*b*. The first circulatory fluid passage 52*a* connects the first traveling motor 51L and the first traveling pump SOL to each other. Therefore, the first traveling pump SOL is capable of supplying hydraulic fluid to the first traveling motor 51L through the first circulatory fluid passage 52*a*. Hence, the speed of rotation (number of revolutions) of the first traveling motor 51L is changeable according to the flow rate of the hydraulic fluid supplied to the first traveling motor 51L from the first traveling pump SOL.

The second circulatory fluid passage 52*b* connects the second traveling motor 51R and the second traveling pump 50R to each other. Therefore, the second traveling pump 50R is capable of supplying hydraulic fluid to the second traveling motor 51R through the second circulatory fluid passage 52*b*. Hence, the speed of rotation (number of revolutions) of the second traveling motor 51R is changeable according to the flow rate of the hydraulic fluid supplied to the second traveling motor 51R from the second traveling pump 50R.

The at least one charging fluid passage 53 allows hydraulic fluid delivered by the first hydraulic pump P1 to be supplied to the circulatory fluid passages 52. The at least one charging fluid passage 53 is connected to a first supply fluid passage 40*a* which branches off from the first delivery fluid passage 40, and hydraulic fluid flowing from the first supply fluid passage 40*a* is supplied to the circulatory fluid passages 52 through the at least one charging fluid passage 53. The at least one charging fluid passage 53 includes at least one fluid passage provided with a check valve at an intermediate portion thereof, and at least one fluid passage provided with a relief valve at an intermediate portion thereof. The check valve allows the flow of hydraulic fluid from the first hydraulic pump P1 toward a corresponding one of the circulatory fluid passages 52 but prohibits the flow of hydraulic fluid from the circulatory fluid passage(s) 52 toward the first hydraulic pump P1. The fluid passage provided with a relief valve is connected to the fluid passage provided with a check valve in such a manner as to bypass the check valve. The at least one charging fluid passage 53 according to the present embodiment includes a first charging fluid passage 53*a* and a second charging fluid passage 53*b*. The first charging fluid passage 53*a* allows hydraulic fluid delivered by the first hydraulic pump P1 to be supplied to the first circulatory fluid passage 52*a*. The second charging fluid passage 53*b* allows hydraulic fluid delivered by the first hydraulic pump P1 to be supplied to the second circulatory fluid passage 52*b*.

As illustrated in FIG. 1, the hydraulic system for the working machine 1 includes at least one first discharge fluid passage 71. The at least one first discharge fluid passage 71 allows hydraulic fluid discharged from the first hydraulic device(s) S to flow into the hydraulic fluid tank T. The at least one first discharge fluid passage 71 according to the present embodiment includes first fluid passage(s) 71*a* and second fluid passage(s) 71*b*. The first fluid passage 71*a* connects the drain ports of the traveling pumps 50 to the hydraulic fluid tank T. Each traveling pump 50 according to the present embodiment allows hydraulic fluid in the circulatory fluid passage 52 to be discharged through the drain port of the traveling pump 50 both in the case where hydraulic fluid is being supplied to the traveling motor 51 and the case where hydraulic fluid is not being supplied to the traveling motor 51. Accordingly, hydraulic fluid discharged from the traveling pumps 50 is allowed to flow into the hydraulic fluid tank T through the first fluid passage 71*a* both in the case where the traveling motor 51 is not being driven and in the case where the traveling motor 51 is being driven.

The second fluid passage(s) 71*b* connects the drain ports of the traveling motors 51 to the hydraulic fluid tank T. Each traveling motor 51 according to the present embodiment allows hydraulic fluid in the circulatory fluid passage 52 to be discharged through the drain port of the traveling motor 51 in the case where hydraulic fluid is being supplied from the traveling pump 50, but does not allow hydraulic fluid to be discharged in the case where hydraulic fluid is not being supplied from the traveling pump 50. Accordingly, hydraulic fluid discharged from the traveling motors 51 is allowed to flow into the hydraulic fluid tank T through the second fluid passage 71*b* in the case where the traveling motor 51 is being driven.

Therefore, when the traveling motor(s) 51 is not being driven, hydraulic fluid supplied from the charging fluid passage(s) 53 to the circulatory fluid passage(s) 52 (that is, hydraulic fluid delivered by the first hydraulic pump P1 to the first hydraulic device(s) S) is discharged to the hydraulic fluid tank T through the first fluid passage(s) 71*a*. On the other hand, when the traveling motor(s) 51 is being driven, hydraulic fluid supplied from the charging fluid passage(s) 53 to the circulatory fluid passage(s) 52 is discharged to the hydraulic fluid tank T through the first fluid passage(s) 71*a* and the second fluid passage(s) 71*b*.

As has been discussed, the first discharge fluid passage(s) 71 allows hydraulic fluid discharged from the first hydraulic device(s) S to flow into the hydraulic fluid tank T. In other words, the first discharge fluid passage(s) 71 allows hydraulic fluid supplied to the first hydraulic device(s) S to be discharged to the hydraulic fluid tank T. When the traveling motor(s) 51 is being driven, the flow rate of hydraulic fluid discharged through the first fluid passage(s) 71*a* to the hydraulic fluid tank T and the flow rate of hydraulic fluid discharged through the second fluid passage(s) 71*b* to the hydraulic fluid tank T change with the number of revolutions of the traveling motor(s) 51, that is, change with the flow rate of hydraulic fluid supplied from the traveling pump(s) 50 to the traveling motor(s) 51.

Note that, although the above description discussed an example case where the at least one first discharge fluid passage 71 includes the first fluid passage 71*a* and the second fluid passage 71*b*, the at least one first discharge fluid passage 71 may, if the hydraulic system for the working machine 1 includes another first hydraulic device S to which hydraulic fluid delivered by the first hydraulic pump P1 is supplied in addition to the traveling pumps 50 and the traveling motors 5, include fluid passage(s) that is/are connected to such a first hydraulic device S in addition to the first fluid passage 71*a* and the second fluid passage 71*b*.

The following description discusses an operation relevant to travel of the working machine 1, that is, an operation of the traveling devices 5 (a traveling operation) in detail. As illustrated in FIG. 1, the working machine 1 includes a traveling-operation device (first operation device) 54.

The first operation device 54 is used to operate the traveling pumps 50 (the first traveling pump SOL and the second traveling pump 50R). The first operation device 54 is capable of changing the angles of the swash plates (swash-plate angles) of the traveling pumps 50 by changing the pilot pressures applied to the forward-traveling pressure receivers 50*a* and the backward-traveling pressure receivers 50*b*. The first operation device 54 includes a first operation member (traveling lever) 55 and a plurality of first operation valves (traveling-operation valves) 56.

The first operation member 55 is an operation lever that is swingable in the left-right direction (machine-body width direction) and in the front-rear direction. The first operation member 55 is supported by the plurality of first operation valves 56. The first operation member 55 is swingable about a neutral position N and can be operated in directions toward the front (represented by arrow A1 in FIG. 1) and the rear (represented by arrow A2 in FIG. 1) and in directions toward the left (represented by arrow A3 in FIG. 1) and the right (represented by arrow A4 in FIG. 1) from the neutral position N. In other words, the first operation member 55 is swingable in at least four directions about the neutral position N.

One or more of the plurality of first operation valves 56 are actuated when the first operation member 55 is operated. Specifically, the plurality of first operation valves 56 are connected to a second supply fluid passage 40*b* which branches off from the first delivery fluid passage 40, and are capable of changing the pressure of pilot fluid (pilot pressure), that is, capable of changing the pressure of hydraulic fluid supplied from the first delivery fluid passage 40. The plurality of first operation valves 56 are operated by the first operation member 55, which is a single operation lever shared among the plurality of first operation valves 56. As illustrated in FIG. 1, the plurality of first operation valves 56 are connected to the traveling pumps 50 through traveling fluid passages 42. The traveling fluid passages 42 connect the plurality of first operation valves 56 to the forward-traveling pressure receivers 50*a* and the backward-traveling pressure receivers 50*b* of the traveling pumps 50.

When the first operation member 55 is operated, one or more of the plurality of first operation valves 56 change the pressure of pilot fluid (pilot pressure), that is, change the pressure of hydraulic fluid supplied from the first delivery fluid passage 40, and the pilot fluid acts on the forward-traveling pressure receivers 50*a* and/or the backward-traveling pressure receivers 50*b* of the traveling pumps 50 through one or more of the traveling fluid passages 42, thus making it possible to operate the traveling pumps 50 (the first traveling pump 50L and the second traveling pump 50R).

The following description discusses the work system portion of the hydraulic system with reference to FIG. 2. The work system portion of the hydraulic system for the working machine 1 actuates the working device 4. The hydraulic system for the working machine 1 includes at least one second hydraulic device C actuated by hydraulic fluid delivered by the second hydraulic pump P2, and a plurality of control valves 60. The at least one second hydraulic device C is actuated by hydraulic fluid delivered by the second hydraulic pump P2 and is configured such that the difference between the flow rate of hydraulic fluid supplied thereto from the second hydraulic pump P2 and the flow rate of hydraulic fluid discharged therefrom changes according to the manner in which the at least one second hydraulic device C is actuated. Specifically, the at least one second hydraulic device C is at least one hydraulic actuator AC to drive the working device 4 and is at least one hydraulic cylinder C. The at least one second hydraulic device C according to the present embodiment includes the boom cylinders 14 and the bucket cylinders 15.

Specifically, each hydraulic cylinder C includes a cylinder tube (tube) c1; a piston c2 provided inside the cylinder tube c1; and a rod c3 attached to the piston c2. The piston c2 is slidable in the axial direction inside the cylinder tube c1. The piston c2 separates the inside of the cylinder tube c1 into a first fluid chamber c1*a* and a second fluid chamber c1*b*. The first fluid chamber c1*a* is a proximal-side chamber (chamber in a portion on the opposite side from the rod c3) of the cylinder tube c1. The second fluid chamber c1*b* is a distal-side chamber (chamber in the portion where the rod c3 is present) of the cylinder tube c1. The proximal portion of the cylinder tube c1 has a first supply/discharge port through which hydraulic fluid is supplied into and discharged from the first fluid chamber c1*a*. The distal portion of the cylinder tube c1 has a second supply/discharge port through which hydraulic fluid is supplied into and discharged from the second fluid chamber c1*b*.

The at least one hydraulic cylinder C is not limited to the boom cylinders 14 and the bucket cylinders 15, provided that the hydraulic cylinder C is a hydraulic actuator AC that includes the cylinder tube c1, the piston c2, and the rod c3 and is extendable and retractable in response to hydraulic fluid. For example, the hydraulic cylinder C included in the hydraulic system for the working machine 1 may be a hydraulic cylinder C included in an auxiliary attachment for the working machine 1.

The plurality of control valves 60 are capable of controlling such hydraulic actuators AC. Specifically, the plurality of control valves 60 are connected to the second delivery fluid passage 45, and are capable of changing the amount (output) and the direction in which the control valves 60 deliver hydraulic fluid supplied from the second delivery fluid passage 45 according to the pilot pressure acting thereon. Thus, the plurality of control valves 60 control the hydraulic actuators AC. The plurality of control valves 60 according to the present embodiment are each a pilot-operated linear-spool three-position switching valve. Each control valve 60 includes pressure receivers 60A and 60B and, in accordance with the pilot pressures received by the pressure receivers 60A and 60B, the control valve 60 switches between the following positions: a third position (neutral position) 60*c*; a first position 60*a* different from the third position 60*c*; and a second position 60*b* different from the third position 60*c* and the first position 60*a*. Thus, the control valves 60 are capable of changing the amount (output) and the direction in which the control valves 60 deliver hydraulic fluid supplied from the second delivery fluid passage 45. The control valves 60 may each be, for example, a three-way solenoid switching valve, provided that the control valve 60 is capable of changing the amount (output) and the direction in which the control valve 60 delivers hydraulic fluid supplied from the second delivery fluid passage 45. In the present embodiment, the plurality of control valves 60 include a first control valve 61, a second control valve 62, and a third control valve 63.

The first control valve 61 controls hydraulic cylinders C (boom cylinders 14) to control the booms 10. The second control valve 62 controls hydraulic cylinders C (bucket cylinders 15) to control the working tool 11. The third control valve 63 controls hydraulic component(s) of the auxiliary attachment.

The plurality of control valves 60 are connected to the hydraulic actuators AC through fluid supply/discharge passages 64. Specifically, the first control valve 61 is connected to the boom cylinders 14 through first fluid supply/discharge passage(s) 64*a*. The second control valve 62 is connected to the bucket cylinders 15 through second fluid supply/discharge passage(s) 64*b*. The third control valve 63 is connected to the auxiliary attachment through third fluid supply/discharge passage(s) 64*c*. The following description discusses the connection of the first control valve 61 and the boom cylinders 14 (hydraulic cylinders C) with the first fluid supply/discharge passage(s) 64*a* in detail, and detailed descriptions for the second fluid supply/discharge passage(s) 64*b* and the third fluid supply/discharge passage(s) 64*c* are omitted.

The first fluid supply/discharge passages 64*a* each have one end connected to a supply/discharge port of the first control valve 61, and the opposite end connected to supply/discharge ports of the hydraulic cylinders C. Specifically, the first fluid supply/discharge passages 64*a* are a first fluid passage 64*a*1 and a second fluid passage 64*a*2. The first fluid passage 64*a*1 connects the supply/discharge port of the first control valve 61 and the first supply/discharge ports of the hydraulic cylinders C to each other. The second fluid passage 64*a*2 connects the supply/discharge port of the first control valve 61 and the second supply/discharge ports of the hydraulic cylinders C to each other. That is, the first fluid passage 64*a*1 allows hydraulic fluid to be supplied into the first fluid chambers c1*a* of the hydraulic cylinders C and allows hydraulic fluid discharged from the first fluid chambers c1*a* of the hydraulic cylinders C to flow therein. On the other hand, the second fluid passage 64*a*2 allows hydraulic fluid to be supplied into the second fluid chambers c1*b* of the hydraulic cylinders C and allows hydraulic fluid discharged from the second fluid chambers c1*b* of the hydraulic cylinders C to flow therein.

Therefore, when the position of the first control valve 61 is switched from the third position 60*c* to the first position 60*a*, the first control valve 61 supplies hydraulic fluid to the first fluid passage 64*a*1 and stops supplying hydraulic fluid to the second fluid passage 64*a*2, thus supplying hydraulic fluid to the first fluid chambers c1*a* through the first fluid passage 64*a*1 and the first supply/discharge ports. Accordingly, the hydraulic fluid supplied to the first fluid chambers c1*a* through the first supply/discharge ports acts on the pistons c2 to cause the pistons c2 to slide toward the distal ends of the cylinder tubes c1. Since the pistons c2 move together with the rods c3, the hydraulic cylinders C extend. Furthermore, the movement of the pistons c2 causes hydraulic fluid in the second fluid chambers c1*b* to be discharged through the second supply/discharge ports into the second fluid passage 64*a*2.

On the other hand, when the position of the first control valve 61 is switched from the third position 60*c* to the second position 60*b*, the first control valve 61 supplies hydraulic fluid to the second fluid passage 64*a*2 and stops supplying hydraulic fluid to the first fluid passage 64*a*1, thus supplying hydraulic fluid to the second fluid chambers c1*b* through the second fluid passage 64*a*2 and the second supply/discharge ports. Accordingly, the hydraulic fluid supplied to the second fluid chambers c1*b* through the second supply/discharge ports acts on the pistons c2 to cause the pistons c2 to slide toward the proximal ends of the cylinder tubes c1. Since the pistons c2 move together with the rods c3, the hydraulic cylinders C retract. Furthermore, the movement of the pistons c2 causes the hydraulic fluid in the first fluid chambers c1*a* to be discharged through the first supply/discharge ports into the first fluid passage 64*a*1.

Note that, in the following description, one of the second fluid supply/discharge passages 64*b* is referred to as a first fluid passage 64*b*1, and the other is referred to as a second fluid passage 64*b*2. One of the third fluid supply/discharge passages 64*c* is referred to as a first fluid passage 64*c*1, and the other is referred to as a second fluid passage 64*c*2.

As illustrated in FIG. 2, the hydraulic system for the working machine 1 includes the second discharge fluid passage 72. The second discharge fluid passage 72 is connected to the second port P1*b* of the first hydraulic pump P1 and allows hydraulic fluid discharged from the second hydraulic devices (hydraulic cylinders) C to flow into the first hydraulic pump P1. The second discharge fluid passage 72 includes a third fluid passage 72*a*, a fourth fluid passage 72*b*, and a fifth fluid passage 72*c*. The third fluid passage 72*a* is connected to the fluid supply/discharge passages 64 and allows hydraulic fluid discharged from the hydraulic cylinders C to flow therethrough. A first end of the third fluid passage 72*a* is separated into portions connected to the first fluid passages 64*a*1, 64*b*1, and 64*c*1 and the second fluid passages 64*a*2, 64*b*2, and 64*c*2 of the first to third fluid supply/discharge passages 64*a* to 64*c*. The third fluid passage 72*a* is provided with a relief valve at the first end thereof.

The fourth fluid passage 72*b* is connected to the third fluid passage 72*a* and allows hydraulic fluid in the third fluid passage 72*a* to flow therethrough. Specifically, a first end of the fourth fluid passage 72*b* is connected to a second end (the opposite end from the first end) of the third fluid passage 72*a*. Thus, hydraulic fluid discharged from the first fluid passages 64*a*1, 64*b*1, and 64*c*1 and the second fluid passages 64*a*2, 64*b*2, and 64*c*2 of the first to third fluid supply/discharge passages 64*a* to 64*c* is allowed to flow into the fourth fluid passage 72*b* through the third fluid passage 72*a*. In the present embodiment, the first end of the fourth fluid passage 72*b* merges with a sixth fluid passage 72*d*. When the third control valve 63 is in the third position 60*c*, hydraulic fluid delivered by the second hydraulic pump P2 is allowed to flow through the sixth fluid passage 72*d*. The fourth fluid passage 72*b* is provided with an oil cooler 73 and an oil filter (return filter) 74 at an intermediate portion thereof.

The fifth fluid passage 72*c* connects the fourth fluid passage 72*b* and the first hydraulic pump P1 to each other and allows hydraulic fluid in the fourth fluid passage 72*b* to be supplied to the first hydraulic pump P1. Specifically, a first end of the fifth fluid passage 72*c* is connected to a second end of the fourth fluid passage 72*b*. Therefore, hydraulic fluid discharged from the first fluid passages 64*a*1, 64*b*1, and 64*c*1 and the second fluid passages 64*a*2, 64*b*2, and 64*c*2 of the first to third fluid supply/discharge passages 64*a* to 64*c* is allowed to flow into the fifth fluid passage 72*c* through the third fluid passage 72*a* and the fourth fluid passage 72*b*.

With such a configuration, hydraulic fluid cooled by the oil cooler 73 is supplied to the first hydraulic pump P1, making it possible to supply the cooled hydraulic fluid to the first hydraulic device S with priority. That is, in the present embodiment, hydraulic fluid flowing through the circulatory fluid passages 52, where the temperature of the hydraulic fluid tends to increase, can be cooled.

The hydraulic system for the working machine 1 includes a connecting fluid passage 36. The connecting fluid passage 36 branches off from the second discharge fluid passage 72 and is connected to the suction fluid passage 35. Specifically, the connecting fluid passage 36 branches off from an intermediate portion (connection point 36*a*) of the fifth fluid passage 72*c* and merges with the suction fluid passage 35. The connecting fluid passage 36 is connected to the portion (connection point 36*b*) of the suction fluid passage 35 that is closer to the second hydraulic pump P2 than the other portions are.

The following description discusses an operation relevant to work to be performed by the working machine 1, that is, an operation of the working device 4 (a working operation) in detail. As illustrated in FIG. 2, the working machine 1 includes a working-operation device (second operation device) 67.

The second operation device 67 is used to operate hydraulic actuators AC of the work system, such as the boom cylinders 14 and the bucket cylinders 15, of all the hydraulic actuators AC. Specifically, the second operation device 67 is capable of changing the amount (output) and the direction in which the control valve(s) 60 discharge hydraulic fluid to the boom cylinders 14 and the bucket cylinders 15 etc. by changing the pilot pressures applied to the pressure receivers 60A and 60B of the control valve(s) 60. The second operation device 67 includes a second operation member (working lever) 68, a plurality of second operation valves (working-operation valves) 69, a plurality of proportional valves 65, and an auxiliary operation member 101.

The second operation member 68 is an operation lever that is swingable in the left-right direction (machine-body width direction) and in the front-rear direction. The second operation member 68 is supported by the plurality of second operation valves 69. The second operation member 68 is swingable about a neutral position N, and is swingable from the neutral position N in directions toward the front (represented by arrow A1 in FIG. 2) and the rear (represented by arrow A2 in FIG. 2) and in directions toward the left (represented by arrow A3 in FIG. 2) and the right (represented by arrow A4 in FIG. 2). In other words, the second operation member 68 is swingable in at least four directions about the neutral position N.

One or more of the plurality of second operation valves 69 are actuated when the second operation member 68 is operated. Specifically, the plurality of second operation valves 69 are connected to a third supply fluid passage 40*c* branching off from the first delivery fluid passage 40. The plurality of second operation valves 69 are capable of changing the pressure of pilot fluid (pilot pressure), that is, changing the pressure of hydraulic fluid supplied from the first delivery fluid passage 40. The plurality of second operation valves 69 are to be operated by the second operation member 68, which is a single operation lever shared among the plurality of second operation valves 69. As illustrated in FIG. 2, the plurality of second operation valves 69 are connected to the first control valve 61 and the second control valve 62 through working fluid passages 46. The working fluid passages 46 connect the second operation valves 69 to the first control valve 61 and the second control valve 62.

When the second operation member 68 is operated, one or more of the plurality of second operation valves 69 change the pressure of pilot fluid (pilot pressure), that is, change the pressure of hydraulic fluid supplied from the first delivery fluid passage 40, and the pilot fluid acts on the pressure receiver(s) 60A and 60B of the first control valve 61 and/or the pressure receiver(s) 60A and 60B of the second control valve 62 through the working fluid passage(s) 46. Thus, the first control valve 61 and the second control valve 62 are operated.

The plurality of proportional valves 65 are used to operate the third control valve 63. Specifically, the proportional valves 65 are each a solenoid valve whose opening is changeable by energization. The proportional valves 65 are connected to a fourth supply fluid passage 40*d* which branches off from the first delivery fluid passage 40. The proportional valves 65 are capable of changing the pressure of pilot fluid (pilot pressure), that is, changing the pressure of hydraulic fluid supplied from the first delivery fluid passage 40. The plurality of proportional valves 65 according to the present embodiment are a first proportional valve 65A and a second proportional valve 65B.

The proportional valves 65 are connected to the pressure receivers 60A and 60B of the third control valve 63 through control fluid passages 66. The control fluid passages 66 each allow pilot fluid supplied from a corresponding one of the proportional valves 65 (the first proportional valve 65A and the second proportional valve 65B) to be supplied to a corresponding one of the pressure receivers 60A and 60B of the third control valve 63.

The auxiliary operation member 101 is a switch to operate the auxiliary attachment. When the auxiliary operation member 101 is operated by an operator or the like, an operation signal is inputted to a controller 100. The controller 100 is provided in the working machine 1 and includes electric and electronic circuit(s), program(s) stored in a central processing unit (CPU) and/or a microprocessor unit (MPU), and/or the like. In response to a switching operation performed on the auxiliary operation member 101, the controller 100 outputs a control signal (for example, voltage, current, or the like) to the plurality of proportional valves 65, thus operating (opening or closing) the proportional valves The auxiliary operation member 101 is, for example, a swingable switch, a slide switch, or a push switch.

Therefore, when the auxiliary operation member 101 is operated, the plurality of proportional valves 65 change the pressure of pilot fluid (pilot pressure), that is, change the pressure of hydraulic fluid supplied from the first delivery fluid passage 40, and the pilot fluid acts on the pressure receiver(s) 60A and 60B of the third control valve 63 through the control fluid passage(s) 66. Thus, the third control valve 63 is operated.

Figure 3:
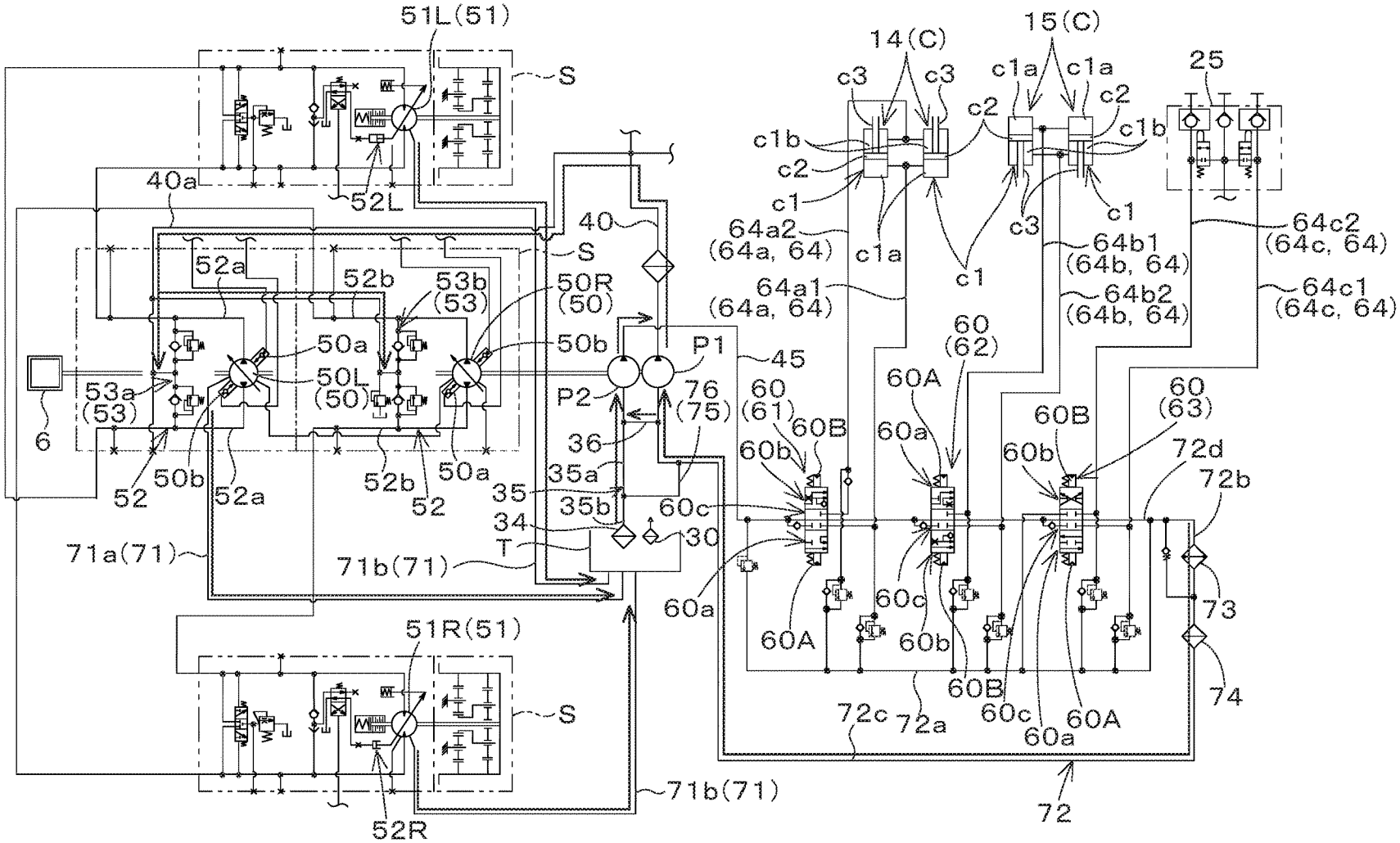
FIG. 3 illustrates how hydraulic fluid flows when the flow rate of return fluid discharged from at least one second hydraulic device is greater than the flow rate of hydraulic fluid sucked by a first hydraulic pump in the first embodiment.
Figure 4:
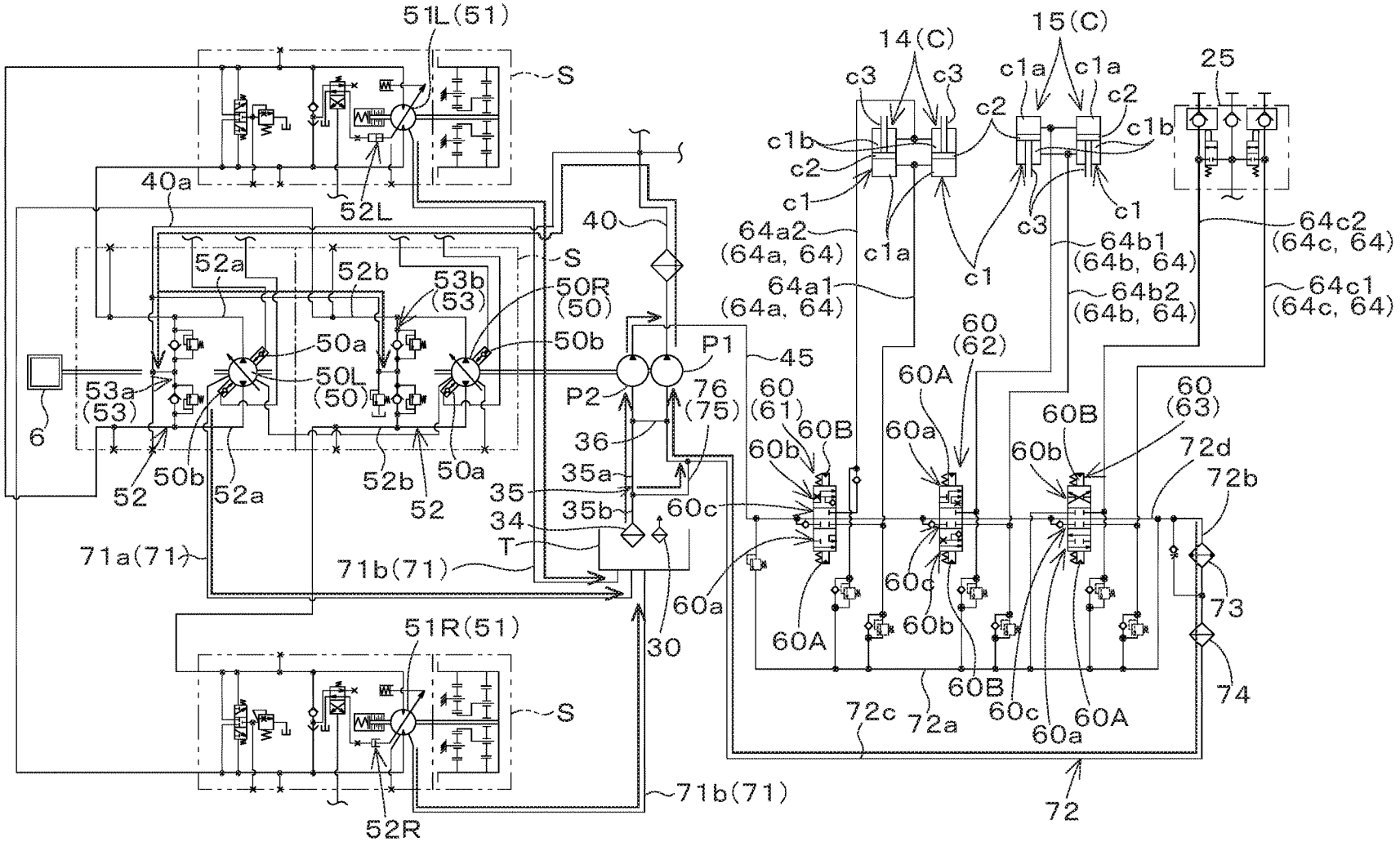
FIG. 4 illustrates how hydraulic fluid flows when the flow rate of return fluid discharged from the at least one second hydraulic device is smaller than the flow rate of hydraulic fluid sucked by the first hydraulic pump in the first embodiment.

The following description discusses the flow of hydraulic fluid from the first hydraulic pump P1 with reference to FIGS. 3 and 4. FIG. 3 illustrates how hydraulic fluid flows if the flow rate of return fluid discharged from the second hydraulic devices C is greater than the flow rate of hydraulic fluid sucked by the first hydraulic pump P1 in the first embodiment. FIG. 4 illustrates how hydraulic fluid flows if the flow rate of return fluid discharged from the second hydraulic devices C is smaller than the flow rate of hydraulic fluid sucked by the first hydraulic pump P1 in the first embodiment. As illustrated in FIGS. 3 and 4, the first hydraulic pump P1 sucks hydraulic fluid from the second discharge fluid passage 72. When the first hydraulic pump P1 delivers hydraulic fluid, the hydraulic fluid flows through the first delivery fluid passage 40 and the first supply fluid passage 40*a* and is supplied to the first hydraulic device(s) S. The hydraulic fluid supplied to the first hydraulic device (s) S is discharged from the first hydraulic device(s) S and flows through the first discharge fluid passage(s) 71 into the hydraulic fluid tank T. Specifically, when the traveling motor(s) 51 is not being driven, hydraulic fluid supplied from the charging fluid passage(s) 53 to the circulatory fluid passage(s) 52 (that is, the hydraulic fluid supplied from the first hydraulic pump P1 to the first hydraulic device(s) S) is discharged to the hydraulic fluid tank T through the first fluid passage(s) 71*a*. On the other hand, when the traveling motor(s) 51 is being driven, the hydraulic fluid supplied from the charging fluid passage(s) 53 to the circulatory fluid passage(s) 52 is discharged to the hydraulic fluid tank T through the first fluid passage(s) 71*a* and the second fluid passage(s) 71*b*.

The second hydraulic pump P2 sucks hydraulic fluid from the hydraulic fluid tank T through the suction fluid passage 35. When the second hydraulic pump P2 delivers hydraulic fluid, the hydraulic fluid flows through the second delivery fluid passage 45 and is supplied to the plurality of control valves 60. The hydraulic fluid supplied to the plurality of control valves 60 flows through the control valves 60 and flows into the second discharge fluid passage 72.

Regarding the cross-sectional areas of the rod c3 and the piston c2 of each hydraulic cylinder C (the cross sections that are orthogonal to the rod c3), the piston c2 has a greater cross-sectional area than the rod c3. That is, the fluid chamber (the second fluid chamber c1*b*) of the cylinder tube c1 where the rod c3 is present and the opposite fluid chamber (the first fluid chamber c1*a*) of the cylinder tube c1 have different cross-sectional areas because of the rod c3. Therefore, when the hydraulic cylinder C extends, the flow rate of hydraulic fluid discharged from the second supply/discharge port is smaller than the flow rate of hydraulic fluid supplied into the first supply/discharge port. On the other hand, when the hydraulic cylinder C retracts, the flow rate of hydraulic fluid discharged from the first supply/discharge port is greater than the flow rate of hydraulic fluid supplied into the second supply/discharge port.

When the piston c2 of the hydraulic cylinder C reaches the stroke end or when the hydraulic cylinder C starts extending, the flow rate of hydraulic fluid discharged from the second fluid chamber c1*b* through the second supply/discharge port particularly is smaller than the flow rate of hydraulic fluid supplied to the first fluid chamber c1*a* through the first supply/discharge port. That is, when the hydraulic cylinder C extends, the amount of hydraulic fluid discharged to the second discharge fluid passage 72 (the amount of return fluid) is reduced.

Therefore, assuming that the flow rate of hydraulic fluid delivered by the first hydraulic pump P1 per predetermined period of time is "F1", the flow rate of hydraulic fluid delivered by the second hydraulic pump P2 per predetermined period of time is "F2", and the flow rate of hydraulic fluid flowing through the second discharge fluid passage 72 per predetermined period of time is "F3", when each hydraulic cylinder C retracts or is not driven, the flow rate F3 of hydraulic fluid flowing through the second discharge fluid passage 72 per predetermined period of time is greater than or equal to the flow rate F2 of hydraulic fluid delivered by the second hydraulic pump P2 per predetermined period of time (F3≥F2). Note that the flow rate F2 of hydraulic fluid delivered by the second hydraulic pump P2 per predetermined period of time is greater than or equal to the flow rate F1 of hydraulic fluid delivered by the first hydraulic pump P1 per predetermined period of time (F2≥F1). Accordingly, the flow rate F3 of hydraulic fluid flowing through the second discharge fluid passage 72 per predetermined period of time is greater than or equal to the flow rate F1 of hydraulic fluid delivered by the first hydraulic pump P1 per predetermined period of time (F3≥F1). Hence, as illustrated in FIG. 3, residual hydraulic fluid in the second discharge fluid passage 72 that has not been sucked into the first hydraulic pump P1 flows through the connecting fluid passage 36 and is sucked into the second hydraulic pump P2.

On the other hand, there are cases in which the hydraulic cylinder(s) C extends and the flow rate F3 of hydraulic fluid flowing through the second discharge fluid passage 72 per predetermined period of time is smaller than the flow rate F2 of hydraulic fluid delivered by the second hydraulic pump P2 per predetermined period of time (F3<F2). Accordingly, the flow rate F3 of hydraulic fluid flowing through the second discharge fluid passage 72 per predetermined period of time may be smaller than the flow rate F1 of hydraulic fluid delivered by the first hydraulic pump P1 per predetermined period of time (F3<F1), and a negative pressure is generated in the second discharge fluid passage 72. In view of such circumstances, the hydraulic system for the working machine 1 according to the present embodiment includes a supplier 75 to eliminate or reduce the likelihood that, because of the negative pressure generated in the second discharge fluid passage 72, hydraulic fluid in the suction fluid passage 35 will be sucked into the second discharge fluid passage 72 through the connecting fluid passage 36.

If hydraulic fluid in the suction fluid passage 35 is sucked into the second discharge fluid passage 72 through the connecting fluid passage 36, the direction of flow of hydraulic fluid in the connecting fluid passage 36 suddenly changes from the direction from the second discharge fluid passage 72 toward the suction fluid passage 35 to the direction from the suction fluid passage 35 toward the second discharge fluid passage 72 (the state illustrated in FIG. 3 changes to the one illustrated in FIG. 4). Therefore, hydraulic fluid to be sucked into the first hydraulic pump P1 becomes insufficient at the point in time at which the flow of hydraulic fluid in the connecting fluid passage 36 reverses (changes), resulting in generation of a negative-pressure surge in the second discharge fluid passage 72. In such a case, the first hydraulic pump P1 cannot deliver hydraulic fluid stably.

The supplier 75 is connected to the second discharge fluid passage 72 and additionally supplies hydraulic fluid to the second discharge fluid passage 72. The supplier 75 according to the present embodiment is a bypass fluid passage 76 which connects the second discharge fluid passage 72 and the hydraulic fluid tank T to each other. The bypass fluid passage 76 branches off from an intermediate portion of the fifth fluid passage 72*c* and merges with an intermediate portion of the suction fluid passage 35. The bypass fluid passage 76 is connected to the fifth fluid passage 72*c* at a first end thereof and to the suction fluid passage 35 at a second end thereof. Preferably, the second end of the bypass fluid passage 76 may be connected to the suction fluid passage 35 such that the bypass fluid passage 76 is in parallel to a tubular member 35*a* which is a portion of the suction fluid passage 35 and which is connected to the second hydraulic pump P2. In other words, it is preferable that the second end of the bypass fluid passage 76 be connected to a fluid passage 35*b* which is a portion of the suction fluid passage 35 and which extends between the tubular member 35*a* and the suction filter 34. Thus, the bypass fluid passage 76 indirectly connects the second discharge fluid passage 72 and the hydraulic fluid tank T to each other independently of the connecting fluid passage 36.

Although the first end of the bypass fluid passage 76 is connected to the fifth fluid passage 72*c* in the present embodiment, the bypass fluid passage 76 need only be connected to a point of the second discharge fluid passage 72 that is located downstream of a merging point where hydraulic fluid flowing from the fluid supply/discharge passages 64 merges with hydraulic fluid flowing in the second discharge fluid passage 72. That is, the first end of the bypass fluid passage 76 may be connected to the fourth fluid passage 72*b*, and the point of connection may be located upstream or downstream of the oil cooler 73 and the return filter 74 or may be located between the oil cooler 73 and the return filter 74.

Although the second end of the bypass fluid passage 76 is connected to the suction fluid passage 35 in the present embodiment, the bypass fluid passage 76 may be directly connected to the hydraulic fluid tank T, provided that the second discharge fluid passage 72 and the hydraulic fluid tank T are connected to each other.

With this, as illustrated in FIG. 4, even if a negative pressure is generated in the second discharge fluid passage 72 with the extension of the hydraulic cylinder(s) C, it is possible to eliminate or reduce the likelihood that the first hydraulic pump P1 will suck hydraulic fluid from the connecting fluid passage 36 and the flow of hydraulic fluid in the connecting fluid passage 36 will change, because the second discharge fluid passage 72 is supplied with hydraulic fluid from the bypass fluid passage 76. In other words, the pressure of hydraulic fluid flowing in the second discharge fluid passage 72 falls within the allowable negative-pressure range for the first hydraulic pump P1, allowing the first hydraulic pump P1 to deliver hydraulic fluid stably.

With regard to the relationship between the inside diameter of the bypass fluid passage 76 and the inside diameters of other fluid passages, the inside diameter of the bypass fluid passage 76 is greater than the inside diameter of the connecting fluid passage 36 and the inside diameter of the second discharge fluid passage 72. Furthermore, the inside diameter of the connecting fluid passage 36 is smaller than the inside diameter of the second discharge fluid passage 72. That is, the following holds. Assuming that the inside diameter of the bypass fluid passage 76 is "p1" the inside diameter of the connecting fluid passage 36 is "p2". and the inside diameter of the second discharge fluid passage 72 is "p3", the relationship between the inside diameter of the bypass fluid passage 76, the inside diameter of the connecting fluid passage 36, and the inside diameter of the second discharge fluid passage 72 is represented by "p1>p3>p2". In the present embodiment, the inside diameter of the bypass fluid passage 76 is equal to the inside diameter of the tubular member 35*a* of the suction fluid passage 35. Therefore, the pressure loss in the bypass fluid passage 76 can be prevented or reduced, and thus the pressure of hydraulic fluid flowing in the second discharge fluid passage 72 more reliably falls within the allowable negative pressure range for the first hydraulic pump P1. Accordingly, the occurrence of a lack of hydraulic fluid to be sucked into the first hydraulic pump P1 can be avoided, making it possible to eliminate or reduce the likelihood that the flow rate of hydraulic fluid in the second discharge fluid passage 72 will increase and the negative pressure in the second discharge fluid passage 72 will increase. This allows the first hydraulic pump P1 to deliver hydraulic fluid stably.

A hydraulic system for a working machine 1 as has been discussed includes: a first hydraulic pump P1; a first hydraulic device S to be actuated by hydraulic fluid delivered by the first hydraulic pump P1; a hydraulic fluid tank T to store hydraulic fluid; a first discharge fluid passage 71 to allow hydraulic fluid discharged from the first hydraulic device S to flow into the hydraulic fluid tank T; a second hydraulic pump P2 to suck hydraulic fluid from the hydraulic fluid tank T through a suction fluid passage 35, the second hydraulic pump P2 being connected to the hydraulic fluid tank T via the suction fluid passage 35; a second hydraulic device C to be actuated by hydraulic fluid delivered by the second hydraulic pump P2, the second hydraulic device C being configured such that a difference between a flow rate of hydraulic fluid supplied from the second hydraulic pump P2 to the second hydraulic device C and a flow rate of hydraulic fluid discharged from the second hydraulic device C changes according to a manner in which the second hydraulic device C is actuated; a second discharge fluid passage 72 to allow hydraulic fluid discharged from the second hydraulic device C to flow into the first hydraulic pump P1, the second discharge fluid passage 72 being connected to a suction port P1*b* of the first hydraulic pump P1; a connecting fluid passage 36 branching off from the second discharge fluid passage 72 and connected to the suction fluid passage 35; and a supplier 75 to additionally supply hydraulic fluid to the second discharge fluid passage 72, the supplier 75 being connected to the second discharge fluid passage 72.

With the configuration, even if a negative pressure is generated in the second discharge fluid passage 72 when the flow rate of hydraulic fluid discharged from the second hydraulic device C is smaller than the flow rate of the hydraulic fluid supplied to the second hydraulic device C, it is possible to eliminate or reduce the likelihood that hydraulic fluid will be sucked from the connecting fluid passage 36 into the first hydraulic pump P1, because hydraulic fluid is supplied to the second discharge fluid passage 72. That is, it is possible to eliminate or reduce the likelihood that the direction of the flow of hydraulic fluid in the connecting fluid passage 36 will change, and the pressure of hydraulic fluid flowing in the second discharge fluid passage 72 falls within the allowable negative-pressure range for the first hydraulic pump P1.

The second hydraulic device C may be a hydraulic cylinder and include a cylinder tube c1, a piston c2 provided inside the cylinder tube c1, and a rod c3 attached to the piston c2.

With the configuration, the fluid chamber (the second fluid chamber c1*b*) of the cylinder tube c1 where the rod c3 is present and the opposite fluid chamber (the first fluid chamber c1*a*) have different cross-sectional areas because of the rod c3. Therefore, especially when the piston c2 of the hydraulic cylinder C reaches the stroke end or when the hydraulic cylinder C starts extending, the flow rate of hydraulic fluid discharged from the hydraulic cylinder C with the extension of the hydraulic cylinder C is smaller than the flow rate of hydraulic fluid supplied to the hydraulic cylinder C, and this may result in generation of a negative pressure in the second discharge fluid passage 72. However, since the second discharge fluid passage 72 is supplied with hydraulic fluid, it is possible to eliminate or reduce the likelihood that hydraulic fluid will be sucked from the connecting fluid passage 36 into the first hydraulic pump P1. That is, it is possible to eliminate or reduce the likelihood that the direction of the flow of hydraulic fluid in the connecting fluid passage 36 will change, and the pressure of hydraulic fluid flowing in the second discharge fluid passage 72 falls within the allowable negative-pressure range for the first hydraulic pump P1.

The supplier 75 may be a bypass fluid passage 76 connecting the second discharge fluid passage 72 and the hydraulic fluid tank T.

With the configuration, since the bypass fluid passage 76 is provided, the second discharge fluid passage 72 can be supplied with hydraulic fluid relatively easily and reliably. Thus, the pressure of hydraulic fluid flowing in the second discharge fluid passage 72 falls within the allowable negative-pressure range for the first hydraulic pump P1.

An inside diameter of the bypass fluid passage 76 may be greater than an inside diameter of the connecting fluid passage 36 and an inside diameter of the second discharge fluid passage 72.

With the configuration, it is possible to prevent or reduce the pressure loss in the bypass fluid passage 76, more reliably prevent hydraulic fluid to be sucked into the first hydraulic pump P1 from becoming insufficient, and eliminate or reduce the likelihood that the flow speed of hydraulic fluid in the second discharge fluid passage 72 will increase and the negative pressure will increase in the second discharge fluid passage 72. Thus, the pressure of hydraulic fluid flowing in the second discharge fluid passage 72 falls within the allowable negative-pressure range for the first hydraulic pump P1.

The second discharge fluid passage 72 may be provided with an oil cooler 73 to cool hydraulic fluid.

With the configuration, hydraulic fluid cooled by the oil cooler 73 is supplied to the first hydraulic pump P1 and therefore the cooled hydraulic fluid can be supplied to the first hydraulic device S with priority. Hence, even if the hydraulic fluid in the first hydraulic device S tends to have a relatively high temperature, the first hydraulic device S is operable in a suitable manner with the supply of the cooled hydraulic fluid.

The hydraulic system for a working machine 1 may further include a prime mover 6. The first hydraulic device S may include a traveling pump 50 to be actuated by power from the prime mover 6, a traveling motor 51 to be rotated by hydraulic fluid delivered by the traveling pump 50, a circulatory fluid passage 52 connecting the traveling pump 50 and the traveling motor 51, and a charging fluid passage 53 to allow hydraulic fluid delivered by the first hydraulic pump P1 to be supplied to the circulatory fluid passage 52.

With the configuration, in the case where the flow rate of hydraulic fluid discharged from the hydraulic cylinder C while the extension of the hydraulic cylinder C is smaller than the flow rate of hydraulic fluid supplied to the hydraulic cylinder C, stable driving of the traveling motor 51 is achieved because the second discharge fluid passage 72 is supplied with additional hydraulic fluid.

A working machine 1 includes the hydraulic system for a working machine 1, a machine body 2, a traveling device 5 to be driven by the first hydraulic device S and to provide a propelling force to the machine body 2, the machine body 2 being provided with the traveling device 5, and a working device 4 to be driven by the second hydraulic device C, the machine body 2 being provided with the working device 4.

With the configuration, even if a negative pressure is generated in the second discharge fluid passage 72 while the working device 4 is being driven, that is, while the second hydraulic device C is actuated, it is possible to eliminate or reduce the likelihood that hydraulic fluid will be sucked from the connecting fluid passage 36 into the first hydraulic pump P1. That is, it is possible to eliminate or reduce the likelihood that the direction of the flow of the hydraulic fluid in the connecting fluid passage 36 will change, and the pressure of hydraulic fluid flowing in the second discharge fluid passage 72 falls within the allowable negative-pressure range for the first hydraulic pump P1. Therefore, regardless of the state of operation of the working device 4, stable supply of hydraulic fluid to the first hydraulic pump P1 is achieved, making it possible to achieve stable driving of the traveling device 4.

Second Embodiment

Figure 5:
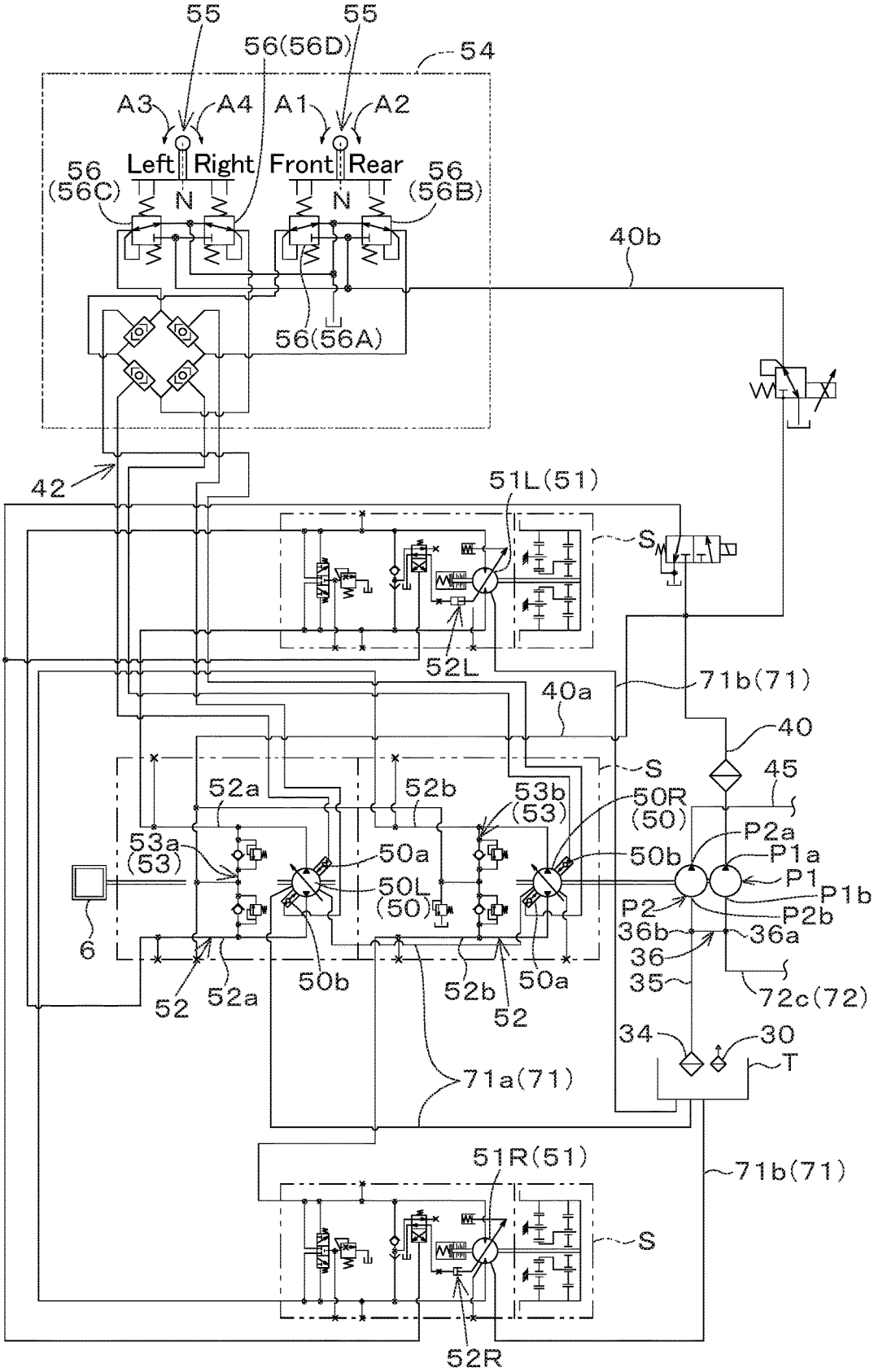
FIG. 5 illustrates a hydraulic circuit of a travel system portion of a hydraulic system for a working machine according to a second embodiment.
Figure 6:
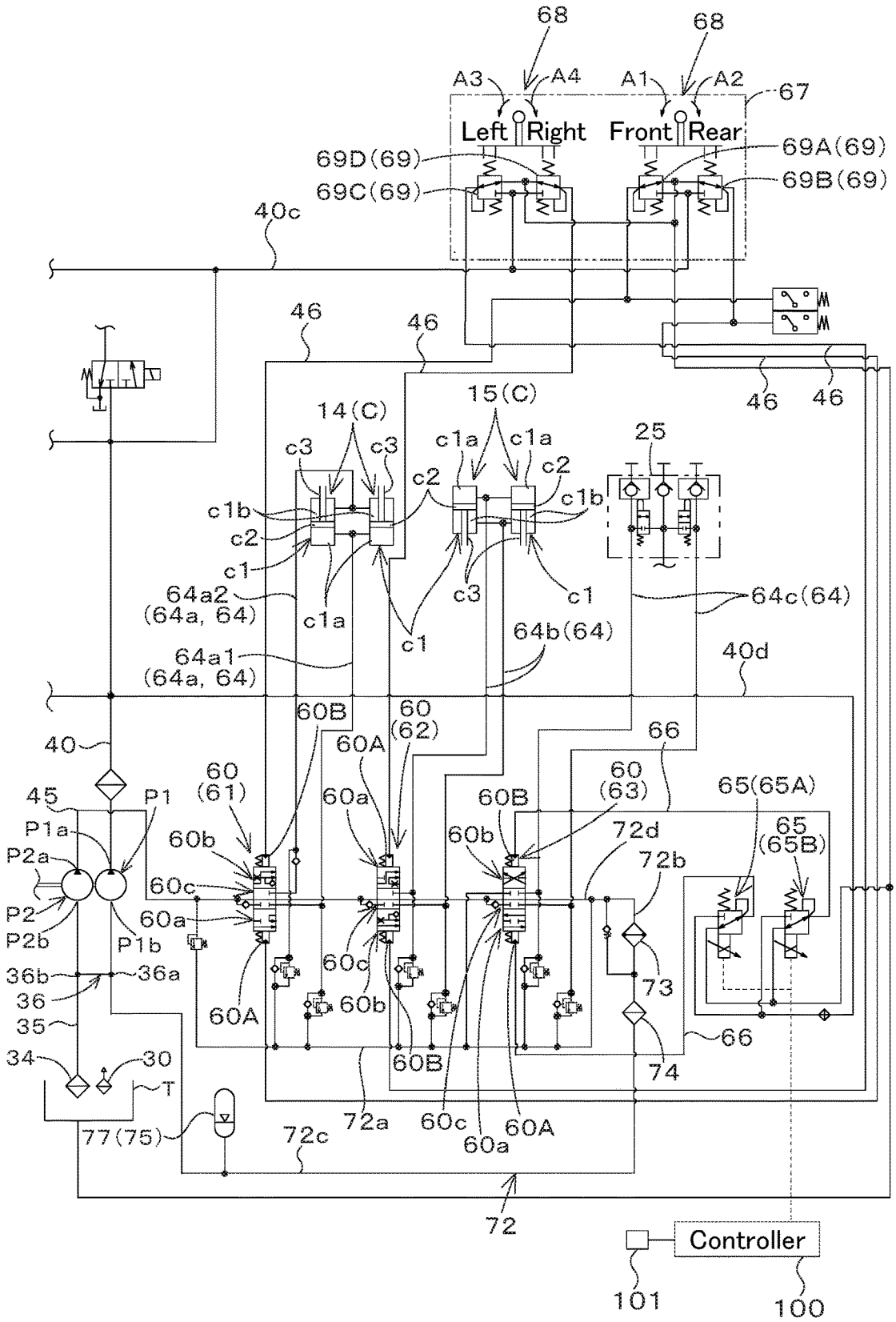
FIG. 6 illustrates a hydraulic circuit of a work system portion of the hydraulic system for a working machine according to the second embodiment.

FIG. 5 illustrates a hydraulic circuit of a travel system portion of a hydraulic system for a working machine 1 according to a second embodiment. FIG. 6 illustrates a hydraulic circuit of a work system portion of the hydraulic system for the working machine 1 according to the second embodiment. The following description of the second embodiment discusses differences from the foregoing embodiments. As illustrated in FIGS. 5 and 6, the supplier 75 according to the second embodiment is an accumulator 77. Although the following description of the second embodiment discusses an example case where the supplier 75 included in the hydraulic system for the working machine 1 is the accumulator 77 in place of the bypass fluid passage 76, the supplier 75 included in the hydraulic system for the working machine 1 may be a combination of the bypass fluid passage 76 and the accumulator 77. The accumulator 77 is connected to the second discharge fluid passage 72, accumulates hydraulic fluid, supplies the accumulated hydraulic fluid to the second discharge fluid passage 72. Therefore, the accumulator 77 is an accumulating device to absorb changes in pressure in the second fluid chamber c1*b* of the hydraulic cylinder C.

The accumulator 77 is connected to a portion of the fifth fluid passage 72*c* that is located upstream of a connection point 36*a* where the connecting fluid passage 36 is connected to the fifth fluid passage 72*c*. Although the accumulator 77 is connected to the fifth fluid passage 72*c* in the present embodiment, the accumulator 77 need only be connected to a point of the second discharge fluid passage 72 that is located downstream of a merging point where hydraulic fluid flowing from the fluid supply/discharge passages 64 merges with hydraulic fluid flowing in the second discharge fluid passage 72. That is, the accumulator 77 may be connected to the fourth fluid passage 72*b*, and the point of connection may be located on upstream or downstream of the oil cooler 73 and the return filter 74 or may be located between the oil cooler 73 and the return filter 74.

With this, if a negative pressure is generated in the second discharge fluid passage 72 with the extension of the hydraulic cylinder(s) C, the accumulator 77 supplies the second discharge fluid passage 72 with hydraulic fluid, making it possible to eliminate or reduce the likelihood that hydraulic fluid will be sucked from the connecting fluid passage 36 into the first hydraulic pump P1. That is, it is possible to eliminate or reduce the likelihood that hydraulic fluid to be sucked into the second hydraulic pump P2 will become insufficient, allowing the second hydraulic pump P2 to discharge hydraulic fluid stably.

The supplier 75 described above may be an accumulator 77 to accumulate hydraulic fluid and supply the accumulated hydraulic fluid to the second discharge fluid passage 72.

With the configuration, since the accumulator 77 is provided, the second discharge fluid passage 72 is supplied with additional hydraulic fluid relatively easily and reliably. Thus, the pressure of hydraulic fluid flowing in the second discharge fluid passage 72 falls within the allowable negative-pressure range for the first hydraulic pump P1.

Third Embodiment

Figure 7:
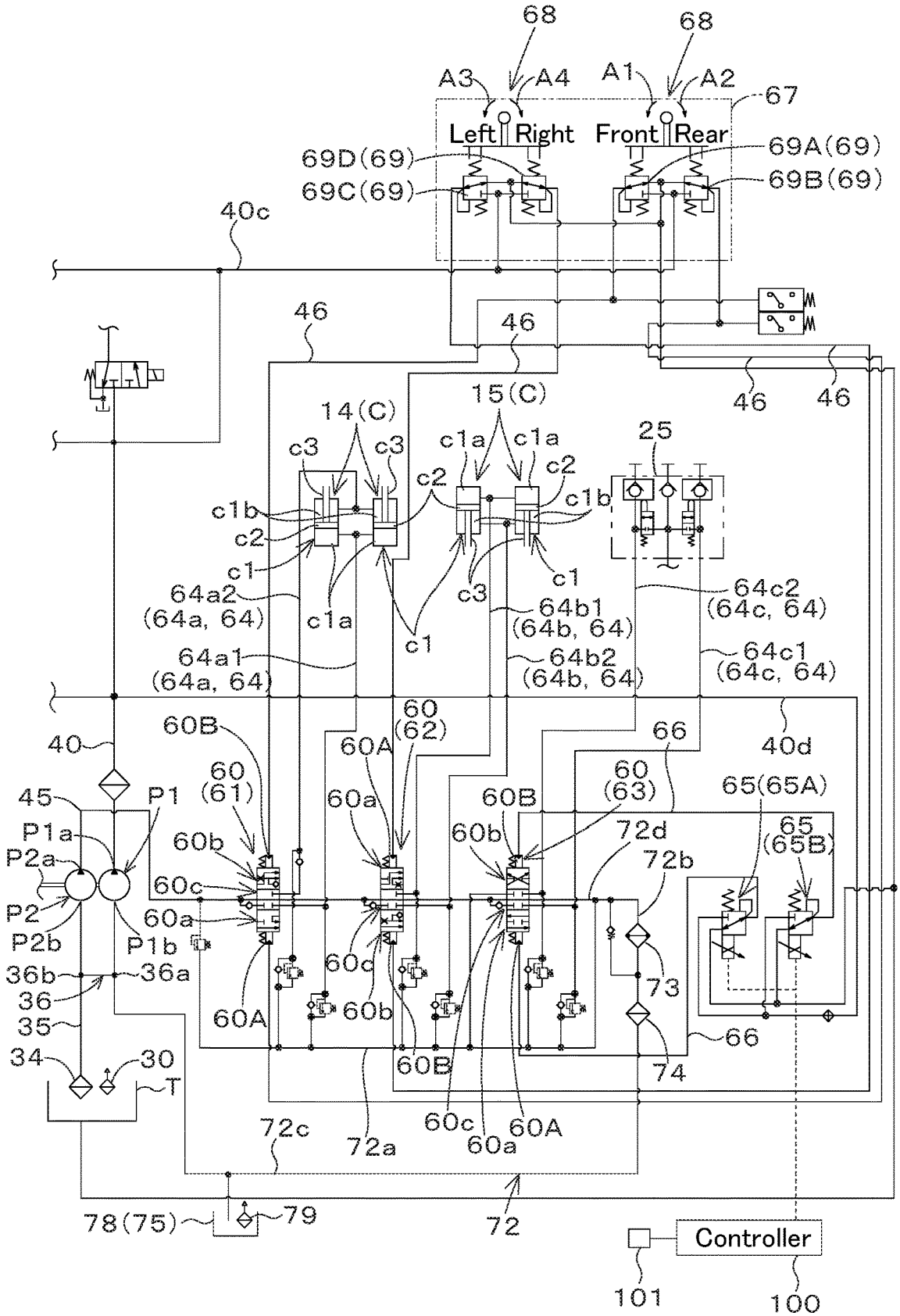
FIG. 7 illustrates a hydraulic circuit of a work system portion of a hydraulic system for a working machine according to a third embodiment.

FIG. 7 illustrates a hydraulic circuit of a work system portion of a hydraulic system for a working machine 1 according to a third embodiment. The following description of the third embodiment discusses differences from the foregoing embodiments. As illustrated in FIG. 7, the supplier 75 according to the third embodiment is an auxiliary tank 78. Although the following description of the third embodiment discusses an example case where the supplier 75 included in the hydraulic system for the working machine 1 is the auxiliary tank 78 in place of at least one of the bypass fluid passage 76 and the accumulator 77, the supplier 75 included in the hydraulic system for the working machine 1 may be a combination of (i) the auxiliary tank 78 and (ii) the bypass fluid passage 76 and/or the accumulator 77.

The auxiliary tank 78 stores hydraulic fluid independently of the hydraulic fluid tank T and supplies the stored hydraulic fluid to the second discharge fluid passage 72. The auxiliary tank 78 is connected to the second discharge fluid passage 72. The auxiliary tank 78 is provided with a breather 79 to allow the inside and the outside of the auxiliary tank 78 to communicate with each other.

The auxiliary tank 78 is connected to a portion of the fifth fluid passage 72*c* that is located upstream of the connection point 36*a* where the connecting fluid passage 36 is connected to the fifth fluid passage 72*c*. Although the auxiliary tank 78 is connected to the fifth fluid passage 72*c* in the present embodiment, the auxiliary tank 78 need only be connected to a point of the second discharge fluid passage 72 that is located on downstream of a merging point where hydraulic fluid flowing from the fluid supply/discharge passages 64 merges with hydraulic fluid flowing in the second discharge fluid passage 72. That is, the auxiliary tank 78 may be connected to the fourth fluid passage 72*b*, and the point of connection may be located on upstream or downstream of the oil cooler 73 and the return filter 74 or may be located between the oil cooler 73 and the return filter 74.

With this, if a negative pressure is generated in the second discharge fluid passage 72 with the extension of the hydraulic cylinder C, the auxiliary tank 78 supplies the second discharge fluid passage 72 with hydraulic fluid, making it possible to eliminate or reduce the likelihood that hydraulic fluid will be sucked from the connecting fluid passage 36 into the first hydraulic pump P1. That is, it is possible to eliminate or reduce the likelihood that hydraulic fluid to be sucked into the second hydraulic pump P2 will become insufficient, allowing the second hydraulic pump P2 to deliver hydraulic fluid stably.

The supplier 75 described above may be an auxiliary tank 78 to store hydraulic fluid independently of the hydraulic fluid tank T and supply the stored hydraulic fluid to the second discharge fluid passage 72.

With the configuration, since the auxiliary tank 78 is provided, the second discharge fluid passage 72 is supplied with additional hydraulic fluid relatively easily and reliably. Thus, the pressure of hydraulic fluid flowing in the second discharge fluid passage 72 falls within the allowable negative-pressure range for the first hydraulic pump P1.

The auxiliary tank 78 may be provided with a breather 79 to allow the inside and the outside of the auxiliary tank 78 to communicate with each other.

With the configuration, even if a negative pressure is generated in the second discharge fluid passage 72, the second discharge fluid passage 72 is more reliably supplied with additional hydraulic fluid from the auxiliary tank 78, and therefore the second discharge fluid passage 72 is supplied with additional hydraulic fluid. Thus, the pressure of hydraulic fluid flowing in the second discharge fluid passage 72 falls within the allowable negative-pressure range for the first hydraulic pump P1.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A hydraulic system for a working machine, the hydraulic system comprising:

a first hydraulic pump;

a first hydraulic device to be actuated by hydraulic fluid delivered by the first hydraulic pump;

a hydraulic fluid tank to store hydraulic fluid;

a first discharge fluid passage to allow hydraulic fluid discharged from the first hydraulic device to flow into the hydraulic fluid tank;

a second hydraulic pump to suck hydraulic fluid from the hydraulic fluid tank through a suction fluid passage, the second hydraulic pump being connected to the hydraulic fluid tank via the suction fluid passage;

a second hydraulic device to be actuated by hydraulic fluid delivered by the second hydraulic pump, the second hydraulic device being configured such that a difference between a flow rate of hydraulic fluid supplied from the second hydraulic pump to the second hydraulic device and a flow rate of hydraulic fluid discharged from the second hydraulic device changes according to a manner in which the second hydraulic device is actuated;

a second discharge fluid passage to allow hydraulic fluid discharged from the second hydraulic device to flow into the first hydraulic pump, the second discharge fluid passage being connected to a suction port of the first hydraulic pump;

a connecting fluid passage branching off from the second discharge fluid passage and connected to the suction fluid passage; and a supplier to additionally supply hydraulic fluid to the second discharge fluid passage, the supplier being connected to the second discharge fluid passage, wherein the supplier is a bypass fluid passage connecting the second discharge fluid passage and the hydraulic fluid tank; and an inside diameter of the bypass fluid passage is greater than an inside diameter of the connecting fluid passage and an inside diameter of the second discharge fluid passage.

2. The hydraulic system according to claim 1, wherein the second hydraulic device is a hydraulic cylinder and includes:

a cylinder tube;

a piston provided inside the cylinder tube; and a rod attached to the piston.

3. The hydraulic system according to claim 1, further comprising a prime mover, wherein the first hydraulic device includes a traveling pump to be actuated by power from the prime mover;

a traveling motor to be rotated by hydraulic fluid delivered by the traveling pump;

a circulatory fluid passage connecting the traveling pump and the traveling motor; and a charging fluid passage to allow hydraulic fluid delivered by the first hydraulic pump to be supplied to the circulatory fluid passage.

4. A working machine comprising:

the hydraulic system according to claim 1;

a machine body;

a traveling device to be driven by the first hydraulic device and to provide a propelling force to the machine body, the machine body being provided with the traveling device; and a working device to be driven by the second hydraulic device, the machine body being provided with the working device.

5. A hydraulic system for a working machine, the hydraulic system comprising:

a first hydraulic pump;

a first hydraulic device to be actuated by hydraulic fluid delivered by the first hydraulic pump;

a hydraulic fluid tank to store hydraulic fluid;

a first discharge fluid passage to allow hydraulic fluid discharged from the first hydraulic device to flow into the hydraulic fluid tank;

a second hydraulic pump to suck hydraulic fluid from the hydraulic fluid tank through a suction fluid passage, the second hydraulic pump being connected to the hydraulic fluid tank via the suction fluid passage;

a second hydraulic device to be actuated by hydraulic fluid delivered by the second hydraulic pump, the second hydraulic device being configured such that a difference between a flow rate of hydraulic fluid supplied from the second hydraulic pump to the second hydraulic device and a flow rate of hydraulic fluid discharged from the second hydraulic device changes according to a manner in which the second hydraulic device is actuated;

a second discharge fluid passage to allow hydraulic fluid discharged from the second hydraulic device to flow into the first hydraulic pump, the second discharge fluid passage being connected to a suction port of the first hydraulic pump;

a connecting fluid passage branching off from the second discharge fluid passage and connected to the suction fluid passage; and a supplier to additionally supply hydraulic fluid to the second discharge fluid passage, the supplier being connected to the second discharge fluid passage, wherein the supplier is an accumulator to accumulate hydraulic fluid and to supply the accumulated hydraulic fluid to the second discharge fluid passage.

6. The hydraulic system according to claim 5, wherein the second hydraulic device is a hydraulic cylinder and includes:

a cylinder tube;

a piston provided inside the cylinder tube; and a rod attached to the piston.

7. The hydraulic system according to claim 5, further comprising a prime mover, wherein the first hydraulic device includes a traveling pump to be actuated by power from the prime mover;

a traveling motor to be rotated by hydraulic fluid delivered by the traveling pump;

a circulatory fluid passage connecting the traveling pump and the traveling motor; and a charging fluid passage to allow hydraulic fluid delivered by the first hydraulic pump to be supplied to the circulatory fluid passage.

8. A working machine comprising:

the hydraulic system according to claim 5;

a machine body;

a traveling device to be driven by the first hydraulic device and to provide a propelling force to the machine body, the machine body being provided with the traveling device; and a working device to be driven by the second hydraulic device, the machine body being provided with the working device.

9. A hydraulic system for a working machine, the hydraulic system comprising:

a first hydraulic pump;

a first hydraulic device to be actuated by hydraulic fluid delivered by the first hydraulic pump;

a hydraulic fluid tank to store hydraulic fluid;

a first discharge fluid passage to allow hydraulic fluid discharged from the first hydraulic device to flow into the hydraulic fluid tank;

a second hydraulic pump to suck hydraulic fluid from the hydraulic fluid tank through a suction fluid passage, the second hydraulic pump being connected to the hydraulic fluid tank via the suction fluid passage;

a second hydraulic device to be actuated by hydraulic fluid delivered by the second hydraulic pump, the second hydraulic device being configured such that a difference between a flow rate of hydraulic fluid supplied from the second hydraulic pump to the second hydraulic device and a flow rate of hydraulic fluid discharged from the second hydraulic device changes according to a manner in which the second hydraulic device is actuated;

a second discharge fluid passage to allow hydraulic fluid discharged from the second hydraulic device to flow into the first hydraulic pump, the second discharge fluid passage being connected to a suction port of the first hydraulic pump;

a connecting fluid passage branching off from the second discharge fluid passage and connected to the suction fluid passage; and a supplier to additionally supply hydraulic fluid to the second discharge fluid passage, the supplier being connected to the second discharge fluid passage, wherein the supplier is an auxiliary tank to store hydraulic fluid independently of the hydraulic fluid tank and to supply the stored hydraulic fluid to the second discharge fluid passage.

10. The hydraulic system according to claim 9, wherein the second hydraulic device is a hydraulic cylinder and includes:

a cylinder tube;

a piston provided inside the cylinder tube; and a rod attached to the piston.

11. The hydraulic system according to claim 9, wherein the auxiliary tank is provided with a breather to allow an inside and an outside of the auxiliary tank to communicate with each other.

12. The hydraulic system according to claim 9, further comprising a prime mover, wherein the first hydraulic device includes a traveling pump to be actuated by power from the prime mover;

a traveling motor to be rotated by hydraulic fluid delivered by the traveling pump;

a circulatory fluid passage connecting the traveling pump and the traveling motor; and a charging fluid passage to allow hydraulic fluid delivered by the first hydraulic pump to be supplied to the circulatory fluid passage.

13. A working machine comprising:

the hydraulic system according to claim 9;

a machine body;

a traveling device to be driven by the first hydraulic device and to provide a propelling force to the machine body, the machine body being provided with the traveling device; and a working device to be driven by the second hydraulic device, the machine body being provided with the working device.

14. A hydraulic system for a working machine, the hydraulic system comprising:

a first hydraulic pump;

a first hydraulic device to be actuated by hydraulic fluid delivered by the first hydraulic pump;

a hydraulic fluid tank to store hydraulic fluid;

a first discharge fluid passage to allow hydraulic fluid discharged from the first hydraulic device to flow into the hydraulic fluid tank;

a second hydraulic pump to suck hydraulic fluid from the hydraulic fluid tank through a suction fluid passage, the second hydraulic pump being connected to the hydraulic fluid tank via the suction fluid passage;

a second hydraulic device to be actuated by hydraulic fluid delivered by the second hydraulic pump, the second hydraulic device being configured such that a difference between a flow rate of hydraulic fluid supplied from the second hydraulic pump to the second hydraulic device and a flow rate of hydraulic fluid discharged from the second hydraulic device changes according to a manner in which the second hydraulic device is actuated;

a second discharge fluid passage to allow hydraulic fluid discharged from the second hydraulic device to flow into the first hydraulic pump, the second discharge fluid passage connecting a suction port of the first hydraulic pump and the second hydraulic device directly without the hydraulic fluid tank therebetween;

a connecting fluid passage including a first end branching off from the second discharge fluid passage and a second end connected to the suction fluid passage; and a supplier to additionally supply hydraulic fluid to the second discharge fluid passage, the supplier being connected to the second discharge fluid passage.

15. The hydraulic system according to claim 14, wherein the second hydraulic device is a hydraulic cylinder and includes:

a cylinder tube;

a piston provided inside the cylinder tube; and a rod attached to the piston.

16. The hydraulic system according to claim 15, wherein the supplier is a bypass fluid passage connecting the second discharge fluid passage and the hydraulic fluid tank.

17. The hydraulic system according to claim 16, wherein the suction fluid passage includes a first end connected to the second hydraulic pump and a second end connected to an oil filter provided in the hydraulic fluid tank; and the bypass fluid passage is different from the connecting fluid passage, and includes a first end connected to the second discharge fluid passage and a second end connected to the suction fluid passage.

18. The hydraulic system according to claim 14, wherein the supplier is a bypass fluid passage connecting the second discharge fluid passage and the hydraulic fluid tank.

19. The hydraulic system according to claim 18, wherein the suction fluid passage includes a first end connected to the second hydraulic pump and a second end connected to an oil filter provided in the hydraulic fluid tank; and the bypass fluid passage is different from the connecting fluid passage, and includes a first end connected to the second discharge fluid passage and a second end connected to the suction fluid passage.

20. The hydraulic system according to claim 14, wherein the second discharge fluid passage is provided with an oil cooler to cool hydraulic fluid.

21. The hydraulic system according to claim 14, further comprising a prime mover, wherein the first hydraulic device includes a traveling pump to be actuated by power from the prime mover;

a traveling motor to be rotated by hydraulic fluid delivered by the traveling pump;

a circulatory fluid passage connecting the traveling pump and the traveling motor; and a charging fluid passage to allow hydraulic fluid delivered by the first hydraulic pump to be supplied to the circulatory fluid passage.

22. A working machine comprising:

the hydraulic system according to claim 14;

a machine body;

a traveling device to be driven by the first hydraulic device and to provide a propelling force to the machine body, the machine body being provided with the traveling device; and a working device to be driven by the second hydraulic device, the machine body being provided with the working device.

* * * * *